US011484942B2

(12) United States Patent
Ohta et al.

(10) Patent No.: US 11,484,942 B2
(45) Date of Patent: Nov. 1, 2022

(54) ALLOY POWDER, FE-BASED NANOCRYSTALLINE ALLOY POWDER AND MAGNETIC CORE

(71) Applicant: HITACHI METALS, LTD., Tokyo (JP)

(72) Inventors: Motoki Ohta, Tokyo (JP); Nobuhiko Chiwata, Tokyo (JP); Tetsuro Kato, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 17/050,029

(22) PCT Filed: Apr. 26, 2019

(86) PCT No.: PCT/JP2019/017920
§ 371 (c)(1),
(2) Date: Oct. 23, 2020

(87) PCT Pub. No.: WO2019/208766
PCT Pub. Date: Oct. 31, 2019

(65) Prior Publication Data

US 2021/0114091 A1 Apr. 22, 2021

(30) Foreign Application Priority Data

| | | |
|---|---|---|
| Apr. 27, 2018 | (JP) | JP2018-086307 |
| May 8, 2018 | (JP) | JP2018-089826 |
| May 18, 2018 | (JP) | JP2018-096304 |
| Dec. 6, 2018 | (JP) | JP2018-229113 |

(51) Int. Cl.
*C22C 38/34* (2006.01)
*B22F 1/054* (2022.01)

(52) U.S. Cl.
CPC ..... *B22F 1/054* (2022.01); *C22C 38/34* (2013.01); *B22F 2301/35* (2013.01); *B22F 2304/054* (2013.01); *B22F 2304/10* (2013.01)

(58) Field of Classification Search
None
See application file for complete search history.

(56) References Cited

U.S. PATENT DOCUMENTS 4,881,989 A 11/1989 Yoshizawa et al.
4,985,089 A * 1/1991 Yoshizawa ..... H01F 1/15366 148/303

(Continued)

FOREIGN PATENT DOCUMENTS

JP 04-004393 B2 1/1992
JP 10-046301 A 2/1998

(Continued)

OTHER PUBLICATIONS

English translation of JP 2014-240516 (originally published Dec. 25, 2014) obtained from Espacenet.*

(Continued)

*Primary Examiner* — George Wyszomierski
(74) *Attorney, Agent, or Firm* — Sughrue Mion, PLLC

(57) ABSTRACT

An alloy powder having an alloy composition represented by $Fe_{100-a-b-c-d-e-f}Cu_aSi_bB_cCr_dSn_eC_f$, wherein a, b, c, d, e and f are atomic % meeting $0.80 \le a \le 1.80$, $2.00 \le b \le 10.00$, $11.00 \le c \le 17.00$, $0.10 \le d \le 2.00$, $0.01 \le e \le 1.50$, and $0.10 \le f \le 0.40$.

8 Claims, 8 Drawing Sheets

(56) References Cited

U.S. PATENT DOCUMENTS

| | | | | |
|---|---|---|---|---|
| 5,160,379 | A | 11/1992 | Yoshizawa et al. | |
| 2010/0043927 | A1* | 2/2010 | Makino | C22C 38/12 148/612 |
| 2012/0199254 | A1 | 8/2012 | Urata et al. | |
| 2017/0148554 | A1 | 5/2017 | Kudo | |
| 2018/0169759 | A1* | 6/2018 | Nakamura | H01F 3/08 |
| 2019/0055635 | A1* | 2/2019 | Kwon | H01F 17/0013 |
| 2019/0156975 | A1 | 5/2019 | Urata et al. | |
| 2019/0362871 | A1* | 11/2019 | Urata | C22C 38/005 |

FOREIGN PATENT DOCUMENTS

| | | | |
|---|---|---|---|
| JP | 2014-136807 | A | 7/2014 |
| JP | 2014-240516 | A | 12/2014 |
| JP | 2017-095773 | A | 6/2017 |
| JP | 6181346 | B2 | 8/2017 |
| JP | 6309149 | B1 | 4/2018 |

OTHER PUBLICATIONS

International Search Report of PCT/JP2019/017920 dated Jul. 30, 2019 [PCT/ISA/210].
Extended European Search Report dated Oct. 15, 2021 in European Application No. 19793222.1.
Office Action dated Jul. 5, 2022 from the China National Intellectual Property Administration in CN Application No. 201980027795.6.

* cited by examiner

ALLOY POWDER, FE-BASED NANOCRYSTALLINE ALLOY POWDER AND MAGNETIC CORE

CROSS REFERENCE TO RELATED APPLICATIONS

This application is a National Stage of International Application No. PCT/JP2019/017920 filed on Apr. 26, 2019, claiming priority based on Japanese Patent Application No. 2018-086307 filed on Apr. 27, 2018, Japanese Patent Application No. 2018-089826 filed on May 8, 2018, Japanese Patent Application No. 2018-096304 filed on May 18, 2018, and Japanese Patent Application No. 2018-229113 filed on Dec. 6, 2018.

FIELD OF THE INVENTION

The present invention relates to an alloy powder, an Fe-based, nanocrystalline alloy powder, and a magnetic core.

BACKGROUND OF THE INVENTION

Fe-based nanocrystalline alloys, typically FeCuNbSiB alloys, are used for magnetic devices used in high frequency ranges, because they have excellent magnetic properties such as low loss and high permeability.

The above nanocrystalline Fe-based alloy having excellent magnetic properties can be obtained by rapidly solidifying an alloy melt by quenching by a single-roll method, etc. to obtain an amorphous alloy ribbon, winding the amorphous alloy ribbon to a magnetic core shape, etc., and heat-treating it in a magnetic field to precipitate nano-crystal grains (see, for example, JP 4-4393 A).

Because the alloy obtained by the above single-roll method is in a ribbon shape, the degree of freedom of a magnetic core shape is limited. Namely, because the magnetic core is formed by slitting an alloy ribbon to a width corresponding to the desired height of a magnetic core, and winding the alloy ribbon to the desired inner and outer diameters, its shape is limited to a toroidal or racetrack shape, etc.

With various magnetic core shapes requested, if alloy powders were produced, magnetic cores of various shapes would be easily formed by them, by forming methods such as pressing, extrusion, etc.

Because magnetic cores having various shapes can be obtained by using magnetic material powders, investigation has been conducted to obtain amorphous alloy powders by rapidly solidifying Fe-based alloy melts for Fe-based nanocrystalline alloys including the above FeCuNbSiB alloys by quenching.

For example, as a method for obtaining powder by rapidly solidifying an alloy melt for the above nanocrystalline Fe-based alloy, an atomizing method by water stream rotating at a high speed (see JP 2017-95773 A), and a water-atomizing method are known. Also, J P 2014-136807 A discloses a method of spraying a flame jet onto a molten metal, which may be called "jet-atomizing method."

However, the production of amorphous alloy powders by quenching a melt by an atomizing method with a high-speed-rotating water stream, etc., encounters problems described below, as compared with the production of alloy ribbons by a single-roll method.

(a) While a single-roll method produces alloy ribbons by rapidly cooling and solidifying an alloy melt by direct contact with a cooled copper alloy, a water-atomizing method, etc. suffer the problem that a steam film generated from water coming into contact with alloy melt particles hinders heat conduction from the alloy to water, resulting in a limited cooling speed.

As a method of overcoming the above problem of hindering heat conduction, there is an atomizing method with a high-speed-rotating water stream for suppressing the formation of a steam film by supplying a high-speed water stream. However, the generation of a steam film cannot completely be prevented theoretically, even by using a steam film-suppressing method such as the atomizing method with a high-speed-rotating water stream, etc., resulting in a more limited cooling speed than in the single-roll method.

(b) While the cooling speed can be easily kept constant with good reproducibility by controlling the thickness of an alloy ribbon to about 20 μm in the single-roll method, the control of alloy melt particle sizes is difficult in the atomizing method with a high-speed-rotating water stream, etc. Because of the unevenness of particle sizes, smaller particles have higher cooling speeds, and larger particles (particularly their inner portions) have lower cooling speeds. Namely, an amorphous phase or a mixed phase of an amorphous phase and fine crystal phases [(Fe—Si) bcc phases] is easily obtained by quenching small particles, while $Fe_2B$ crystals deteriorating magnetic properties tend to be precipitated by quenching large particles. In the quenched alloy powder containing a large amount of $Fe_2B$ crystals deteriorating magnetic properties, $Fe_2B$ crystals remain after heat treatment, making it difficult to obtain low loss, one of excellent magnetic properties.

With respect to the magnetic alloy powder, there are further the following problems.

(c) The phenomenon (skin effect) that a high-frequency magnetic flux flows only near a surface of the magnetic alloy powder takes place more remarkably in higher-frequency applications, and when surface portions of the magnetic alloy powders are magnetically saturated, the surface portions loose a function as a magnetic material, likely resulting in the deterioration of the magnetic properties of the magnetic alloy powders.

(d) Because magnetic cores formed by the Fe-based, nanocrystalline alloy powder have low initial permeability μi, their permeability becomes lower than the initial permeability μi at higher magnetic field intensity H, failing to exhibit good DC superimposition characteristics.

As described above, there are the following requirements in the Fe-based, nanocrystalline alloy powder.

(1) The quenched alloy powder before nanocrystallization should be in an amorphous phase or a mixed phase of an amorphous phase and fine crystal phases [(Fe—Si) bcc phases]. Also, the formation of $Fe_2B$ crystals should be suppressed. The fine crystal phases are those not becoming coarser (growing) by heat treatment.

(2) The alloy should have a composition exhibiting as high a saturation magnetic flux density Bs as suppressing magnetic saturation in high-frequency applications.

(3) Magnetic cores formed by the heat-treated, Fe-based, nanocrystalline alloy powder should have high initial permeability μi and excellent DC superimposition characteristics.

OBJECTS OF THE INVENTION

Accordingly, an object of the present invention is to provide an alloy powder stably composed of an amorphous phase or a mixed phase of an amorphous phase and fine crystal phases [(Fe—Si) bcc phases], with the formation of $Fe_2B$ crystals suppressed, after quenching.

Another object of the present invention is to provide an Fe-based, nanocrystalline alloy powder obtained by heat-treating the above alloy powder for having excellent magnetic properties, and a magnetic core formed by the Fe-based, nanocrystalline alloy powder for exhibiting excellent magnetic properties.

SUMMARY OF THE INVENTION

As a result of intensive research in view of the above objects, the inventors have found that the above problems can be solved by the alloy powder, the Fe-based, nanocrystalline alloy powder and the magnetic core described below. The present invention has been completed based on such findings.

Thus, the alloy powder of the present invention has an alloy composition represented by $Fe_{100-a-b-c-d-e-f}Cu_aSi_bB_cCr_dSn_eC_f$, wherein a, b, c, d, e and f are atomic % meeting $0.80 \le a \le 1.80$, $2.00 \le b \le 10.00$, $11.00 \le c \le 17.00$, $0.10 \le d \le 2.00$, $0.01 \le e \le 1.50$, and $0.10 \le f \le 0.40$.

The Fe-based, nanocrystalline alloy powder of the present invention has an alloy composition represented by $Fe_{100-a-b-c-d-e-f}Cu_aSi_bB_cCr_dSn_eC_f$, wherein a, b, c, d, e and f are atomic % meeting $0.80 \le a \le 1.80$, $2.00 \le b \le 10.00$, $11.00 \le c \le 17.00$, $0.10 \le d \le 2.00$, $0.01 \le e \le 1.50$, and $0.10 \le f \le 0.40$, and an alloy structure containing 20% or more by volume of nanocrystalline structures having an average crystal grain size of 10-50 nm.

The Fe-based, nanocrystalline alloy powder preferably has a saturation magnetic flux density Bs of 1.50 T or more.

The Fe-based, nanocrystalline alloy powder preferably contains in the alloy structure substantially rectangular structures having longitudinal lengths of 20 nm or more and transverse widths of 10-30 nm.

The substantially rectangular structures are preferably observed in Fe-based, nanocrystalline alloy powders having particle sizes of more than 20 μm.

It is preferable that in the Fe-based, nanocrystalline alloy powder, powder having particle sizes of more than 40 μm is 10% or less by mass of the entire powder, powder having particle sizes of more than 20 μm and 40 μm or less is 30% or more and 90% or less by mass of the entire powder, and powder having particle sizes of 20 μm or less is 5% or more and 60% or less by mass of the entire powder.

The magnetic core of the present invention is formed by the above Fe-based, nanocrystalline alloy powder.

The magnetic core preferably has μ10 k/μi of 0.90 or more, wherein μ10 k is permeability at a magnetic field intensity H=10 kA/m, and μi is initial permeability. The initial permeability μi is preferably 15.0 or more.

Effects of the Invention

Because the alloy powder of the present invention is composed of an amorphous phase or a mixed phase of an amorphous phase and fine crystal phases, with the formation of $Fe_2B$ crystals suppressed, before nanocrystallization after quenched, an Fe-based, nanocrystalline alloy powder having excellent magnetic properties can be obtained by heat-treating this alloy powder for nanocrystallization. Using this Fe-based, nanocrystalline alloy powder of the present invention, magnetic cores having excellent magnetic properties can be obtained.

BRIEF DESCRIPTION OF THE DRAWINGS

FIG. 1(*b*) is a schematic view for explaining the transmission electron microscopic (TEM) photograph of FIG. 1(*a*).

DESCRIPTION OF THE PREFERRED EMBODIMENTS

Figure 1A:
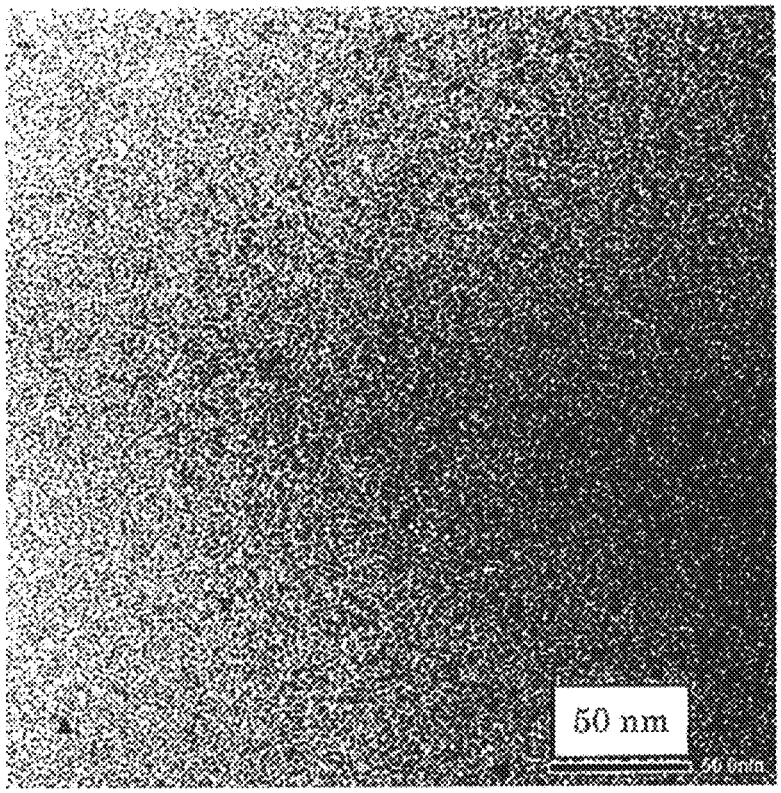
FIG. 1(*a*) is a transmission electron microscopic (TEM) photograph showing a mixed phase of an Fe-based amorphous phase and fine crystal phases in the quenched powder of Alloy A of Example 1.

The alloy powder, Fe-based, nanocrystalline alloy powder and magnetic core according to the embodiments of the present invention will specifically be explained, though the present invention is not restricted thereto. In the specification, the numerical ranges expressed by using "-" are those including the lower and upper limits described on both sides of "-."

[1] Composition

The alloy powder according to an embodiment of the present invention has an alloy composition represented by $Fe_{100-a-b-c-d-e-f}Cu_aSi_bB_cCr_dSn_eC_f$, wherein a, b, c, d, e and f are atomic % meeting $0.80 \le a \le 1.80$, $2.00 \le b \le 10.00$, 11.00≤c≤17.00, 0.10≤d≤2.00, 0.01≤e≤1.50, and 0.10≤f≤0.40. The Fe-based, nanocrystalline alloy powder according to another embodiment of the present invention has the same alloy composition.

The quenching of an alloy melt having the above composition can produce an alloy powder composed of an amorphous phase alone, or a phase having fine crystals having an average crystal grain size of less than 10 nm, which may be called clusters, precipitated in an amorphous phase (namely, a mixed phase of an amorphous phase and fine crystal phases), in which the formation of $Fe_2B$ crystals is suppressed. The average crystal grain size of the nanocrystalline phases is calculated by the Scherrer' equation described below. The alloy powder obtained by quenching an alloy having the above composition is called herein "alloy powder," unless otherwise mentioned, and the alloy powder having an alloy structure containing nanocrystals, which is obtained by heat-treating this "alloy powder," is called herein "Fe-based, nanocrystalline alloy powder."

The alloy powder with the formation of $Fe_2B$ crystals suppressed is composed of an amorphous phase only, a phase having fine crystals having an average crystal grain size of less than 10 nm, which may be called "clusters," precipitated in an amorphous phase, or a phase having a trace amount of fine $Fe_2B$ crystals precipitated in these phases. In the X-ray diffraction (XRD) measurement, the quenched alloy powder having a trace amount of fine $Fe_2B$ crystals exhibits a diffraction peak of a (002) plane or a synthesized diffraction peak of the (022) and (130) planes of $Fe_2B$, whose intensities are both 15% or less per 100% of the diffraction peak intensity of the (110) plane of the (Fe—Si) bcc phases. In the alloy powder according to the embodiment of the present invention, these diffraction peak intensities are more preferably 5% or less, further preferably 3% or less, and most preferably substantially 0%. Alloy powders having smaller particle sizes tend to exhibit smaller diffraction peak intensities of $Fe_2B$. $Fe_2B$ crystals are not formed in the alloy powder having only an amorphous phase.

An Fe-based, nanocrystalline alloy powder having nanocrystalline phases [(Fe—Si) bcc phases] having an average crystal grain size of 10-50 nm can be obtained by heat-treating the alloy powder obtained by quenching a melt having the above alloy composition. The alloy structure of the Fe-based, nanocrystalline alloy powder according to the embodiment of the present invention is a nanocrystalline structure comprising nanocrystalline phases and an amorphous phase. This Fe-based, nanocrystalline alloy powder need not have nanocrystalline structures having an average crystal grain size of 10-50 nm in all regions of its alloy structure, but need only have nanocrystalline structures in 20% or more by volume of the region. Regions of the alloy powder occupied by nanocrystalline structures having an average crystal grain size of 10-50 nm are preferably 30% or more by volume, more preferably 40% or more by volume, further preferably 50% or more by volume, and most preferably 60% or more by volume.

The average crystal grain size D of the nanocrystalline phases can be obtained by determining a half width (radian) of a (Fe—Si) bcc peak in the X-ray diffraction (XRD) pattern of the alloy powder (or Fe-based, nanocrystalline alloy powder), and calculating the Scherrer's equation of $D=0.9\times\lambda/(\text{half width})\times\cos\theta$), wherein $\lambda$ is an X-ray wavelength of an X-ray source. For example, $\lambda=0.1789$ nm for an X-ray source of CoK$\alpha$, and k=0.15406 nm for an X-ray source of CuK$\alpha$1. The volume fraction of nanocrystalline phases is determined by observing the alloy structure by a transmission electron microscope (TEM), summing the areas of nanocrystalline phases, and calculating its ratio to the area of the observed field.

In the Fe-based, nanocrystalline alloy powder according to the embodiment of the present invention, the volume fraction of nanocrystalline phases having an average crystal grain size of 10-50 nm is about 20-60% of its all structure region, though it may be 60% or more by volume. Other portions than the nanocrystalline structures are mostly amorphous structures. Coarse crystal grains such as dendrite phases, etc. may partially exist. Such Fe-based, nanocrystalline alloy powder has excellent magnetic properties as described below in detail. Incidentally, the Fe-based, nanocrystalline alloy powder is a type of the alloy powder of the present invention.

With respect to the above alloy composition of $Fe_{100-a-b-c-d-e-f}Cu_aSi_bB_cCr_dSn_eC_f$, wherein a, b, c, d, e and f are atomic % meeting 0.80≤a≤1.80, 2.00≤b≤10.00, 11.00≤c≤17.00, 0.10≤d≤2.00, 0.01≤e≤1.50, and 0.10≤f≤0.40, detailed explanations will be made below.

Fe is a main element determining the saturation magnetic flux density Bs. To obtain a high saturation magnetic flux density Bs, the Fe content is preferably 77.00 atomic % or more, and more preferably 79.00 atomic % or more. In the formula expressing the above alloy composition, the value of (100-a-b-c-d-e-f) includes those of impurities other than elements constituting the above alloy composition, in addition to Fe. The total amount of impurities is preferably 0.20 atomic % or less, and more preferably 0.10 atomic % or less.

The alloy structure of the Fe-based, nanocrystalline alloy powder according to the embodiment of the present invention has nanocrystalline structures. The nanocrystals include those growing from the above fine crystals and those formed with Cu atoms as nuclei, which have a bcc structure containing an Fe—Si alloy as a main component. To form Cu atoms acting as nuclei for nanocrystals and fine crystals uniformly in the alloy structure, the Cu content is 0.80 atomic % or more. The Cu content is preferably 1.00 atomic % or more, and further preferably 1.15 atomic % or more. On the other hand, when the Cu content is more than 1.80 atomic %, relatively large crystals are likely formed in the quenched alloy powder before heat treatment, and they grow to coarse crystal grains after heat treatment, deteriorating magnetic properties. Accordingly, to suppress the generation of coarse crystal grains after heat treatment, the Cu content is 1.80 atomic % or less. The Cu content is preferably 1.60 atomic % or less, and further preferably 1.50 atomic % or less.

Sn is an element increasing the effect of uniformly forming Cu atoms acting as nuclei for nanocrystals and fine crystals in the alloy structure. It also has an effect of suppressing the formation of coarse crystal grains by heat treatment. Namely, even in regions having relatively low Cu concentrations, Sn makes it easy to form nanocrystals. Further, magnetic cores formed by the Fe-based, nanocrystalline alloy powder containing Sn tend to have low loss.

To exhibit the above effect remarkably, the Sn content is 0.01 atomic % or more. The Sn content is preferably 0.05 atomic % or more, more preferably 0.10 atomic % or more, further preferably 0.15 atomic % or more, still further preferably 0.20 atomic % or more, still further preferably 0.30 atomic % or more, and most preferably 0.40 atomic % or more. On the other hand, the Sn content is 1.50 atomic % or less to obtain a high saturation magnetic flux density. The Sn content is more preferably 1.00 atomic % or less, further preferably 0.80 atomic %, still further preferably 0.70 atomic %, still further preferably 0.60 atomic %, and most preferably 0.55 atomic % or less. When the Sn content is more than the Cu content (e>a), the above effect is suppressed. Accordingly, the Sn content preferably does not exceed the Cu content.

Si is an element of forming with Fe an alloy having bcc phases [(Fe—Si) bcc phases] as nanocrystalline phases by the heat treatment. It also acts to form an amorphous phase by quenching. To form an amorphous phase by quenching with good reproducibility, the Si content is 2.00 atomic % or more. The Si content is preferably 3.00 atomic % or more, and further preferably 3.50 atomic % or more. On the other hand, to secure the reproducibility of the viscosity of the alloy melt, and the uniformity and reproducibility of particle sizes of the alloy powder formed by quenching, the Si content is 10.00 atomic % or less. The Si content is preferably 8.00 atomic % or less, and further preferably 7.00 atomic % or less.

B is an element acting to form an amorphous phase by quenching, like Si. B also acts to uniformly disperse Cu atoms as nuclei for nanocrystals without segregation in the alloy structure (in the amorphous phase). To form an amorphous phase by quenching and disperse Cu atoms uniformly in the amorphous phase with good reproducibility, the B content is 11.00 atomic % or more. The B content is preferably 12.00 atomic % or more. To obtain a high saturation magnetic flux density Bs, the B content is 17.00 atomic % or less, though variable depending on the total amount of B and Si as described below. The B content is preferably 15.50 atomic % or less.

Because the amounts of Si and B are relatively large in the alloy composition, they have large influence on the Fe content. Namely, larger amounts of Si and B lead to a relatively smaller amount of Fe, providing the Fe-based, nanocrystalline alloy powder with a lower saturation magnetic flux density Bs. To obtain a high saturation magnetic flux density Bs, the total amount of Si and B is preferably 20.00 atomic % or less ($b+c \leq 20.00$), and more preferably 18.00 atomic % or less ($b+c \leq 18.00$).

Cr has an effect of improving the corrosion resistance of the alloy powder. Cr also has an effect of improving the DC superimposition characteristics of a magnetic core formed by the Fe-based, nanocrystalline alloy powder. To obtain these effects, the Cr content is 0.10 atomic % or more. The Cr content is preferably 0.20 atomic % or more, more preferably 0.30 atomic % or more, and further preferably 0.40 atomic % or more. On the other hand, because Cr does not contribute to improving the saturation magnetic flux density, it is 2.00 atomic % or less. The Cr content is preferably 1.50 atomic % or less, more preferably 1.30 atomic % or less, further preferably 1.20 atomic % or less, still further preferably 1.00 atomic % or less, still further preferably 0.90 atomic % or less, and most preferably 0.80 atomic % or less. With more than 0.10 atomic % and less than 1.00 atomic % of Cr, magnetic cores having low loss P are expected.

C acting to stabilize the viscosity of the alloy melt is 0.10 atomic % or more. The C content is preferably 0.20 atomic % or more, and further preferably 0.22 atomic % or more. To suppress the change of soft magnetic properties with time, the C content is 0.40 atomic % or less. The Cr content is preferably 0.37 atomic % or less, and further preferably 0.35 atomic % or less.

[2] Alloy Powder (1) Production Method

The alloy powder according to the embodiment of the present invention can be obtained by quenching an alloy melt having the above composition by an atomizing method, etc. This production method will be explained in detail below.

First, element sources such as pure iron, ferroboron, ferrosilicon, etc. are mixed to have a desired alloy composition, and heated by an induction heating furnace, etc. to a melting point or higher to melt them, obtaining an alloy melt having the above alloy composition.

This alloy melt is quenched by an atomizing method, etc. by the apparatus (jet-atomizing apparatus) described in JP 2014-136807 A, etc., to produce an alloy powder. There are various known atomizing methods, and their production conditions can properly be designed based on known production technologies.

The alloy powder obtained by the above method corresponds to the alloy powder according to the embodiment of the present invention. This quenched alloy powder according to the embodiment of the present invention is composed of an amorphous phase alone, or a mixed phase comprising fine crystals having an average crystal grain size of less than 10 nm precipitated in an amorphous phase, namely, a mixed phase of an amorphous phase and fine crystal phases, which may be called clusters, with the formation of $Fe_2B$ crystals suppressed.

In the production of the Fe-based, nanocrystalline alloy powder comprising substantially rectangular nanocrystalline structures described below, a high-speed flame-atomizing method is particularly suitable. Though the high-speed flame-atomizing method is not used as generally as other atomizing methods, for example, the method described in JP 2014-136807 A, etc. is usable. In the high-speed flame-atomizing method, a melt disintegrated by high-speed flame generated by a high-speed combustor is cooled by a rapid-cooling mechanism comprising pluralities of nozzles ejecting a cooling medium such as liquid nitrogen, liquefied carbon dioxide, etc.

It is known that particles obtained by the atomizing method are nearly spherical, and that the cooling speed largely depends on particle sizes. When disintegrated melt particles pass in a liquid or gas having higher heat-exchanging efficiency (for example, water, He or steam) than that of the air at a high speed, their surfaces are cooled at a high speed. With heat removed from their surfaces efficiently, their inner portions are also cooled by heat conduction, but uneven cooling speed causes volume difference between early solidified surface portions and later solidified center portions. Larger alloy particles suffer more unevenness in the cooling speed.

In the above high-speed flame-atomizing method, the disintegrated melt is quenched to a supercooled glass state at an early stage of the cooling process. Because of self-relaxation of strain by volume difference, regions having different stress distributions as large as $(\text{submicrons})^3$ to $(\text{several microns})^3$ in volume are generated in particles being cooled. It is considered that the regions receive stress from each other due to the restraint of ambient regions. It is also considered that during separation of crystal phases from an amorphous phase in the cooling process, the precipitation of FeSi crystals starts in the amorphous phase under stress with Cu clusters as starting sites, causing creep accompanied by the migration of atoms in the amorphous phase, thereby inducing the formation of next crystal grains from ends of FeSi crystals, so that the growth of crystal grains proceeds in a stress direction, resulting in crystal grains growing in a rosary manner with their lattices continuously connected on the atom level.

The inventors' investigation has revealed that the high-speed flame-atomizing method can produce both particles having substantially rectangular structures described below and particles having granular structures. It is observed that particles of typically 10 μm or less in particle size produced by the high-speed flame-atomizing method tend to be cooled more rapidly than ribbons produced by the single roll method, as long as their compositions are the same. At a higher cooling speed while forming powder, cooling speed distributions are smaller in the particles, with smaller strain and stress distributions, so that substantially amorphous particles are formed, resulting in difficulty in obtaining particles containing FeSi crystals having substantially rectangular structures. If such particles are heat-treated like conventional nanocrystalline alloys, FeSi crystals having granular structures are formed like the conventional ones.

When particles have particle sizes of more than 10 μm, typically about 20 μm, there is large cooling speed difference between their inner and surface portions, so that strain due to time difference in volume change during cooling is accumulated, precipitating more FeSi crystals having substantially rectangular structures in the inner portions cooled more slowly.

Such findings make it possible to obtain powder comprising particles containing FeSi crystals having substantially rectangular structures and particles containing FeSi crystals having granular structures even by one atomizing treatment, as long as the powder contains at least particles having particle sizes of about 10-20 μm. By classifying such powder, it is possible to obtain Fe-based, nanocrystalline alloy powders comprising particles having substantially rectangular structures and particles having granular structures at different ratios.

(2) Classification

The alloy powder obtained by the above method according to the embodiment of the present invention is not even in particle size but has a wide particle size distribution. Because the suitable size of the alloy powder differs depending on its applications, it is preferable to conduct classification to obtain powder having suitable particle sizes for its applications. Classification enables the use of alloy powder having small particle sizes and alloy powder having medium particle sizes. Also, alloy powder in which alloy powder having small particle sizes and alloy powder having medium particle sizes are mixed can be obtained. The different features of the alloy powder depending on their particle sizes will be explained below.

(a) Alloy Powder Having Small Particle Sizes

First, alloy powder having small particle sizes will be explained. With small particle sizes, the alloy powder is easily quenched at a desired cooling speed, stably obtaining an amorphous phase, or a mixed phase of an amorphous phase and fine crystal phases. Also, the formation of $Fe_2B$ crystals is suppressed. Fe-based, nanocrystalline alloy powder obtained by heat-treating this alloy powder having small particle sizes has such a high saturation magnetic flux density Bs that magnetic saturation can be suppressed even in high-frequency applications.

To obtain the above effect, for example, the alloy powder preferably has particle sizes of 20 μm or less. However, having particle sizes of more than 20 μm does not mean that the above effect cannot be obtained. Even alloy powder having particle sizes of more than 20 μm may be able to obtain the above effect. For example, some alloy powder having particle sizes of 30 μm or 32 μm may exhibit the effect of the alloy powder having smaller particle sizes.

For example, alloy powder having particle sizes of 20 μm or less can be obtained as the alloy powder having small particle sizes, by classifying the alloy powder by a sieve to remove powder of more than 20 μm. Alloy powder having the maximum particle size of 20 μm or less, which is classified by a sieve, is also composed of an amorphous phase, or a mixed phase of an amorphous phase and fine crystal phases, with the formation of $Fe_2B$ crystals suppressed.

As described below, to obtain Fe-based, nanocrystalline alloy powder having improved magnetic properties with the formation of $Fe_2B$ crystals suppressed by heat treatment, the particle sizes of the quenched alloy powder is more preferably 15 μm or less, and most preferably 10 μm or less. With the particle sizes of 10 μm or less, the formation of $Fe_2B$ crystals is suppressed to such an extent that $Fe_2B$ peaks are not observed with good reproducibility in the X-ray diffraction (XRD) measurement.

To suppress the unevenness of the magnetic properties of magnetic cores formed by the heat-treated, Fe-based, nanocrystalline alloy powder, the particle sizes of the alloy powder preferably have a lower limit. Thus, the particle sizes of the alloy powder are preferably 3 μm or more, and more preferably 5 μm or more.

(2) Alloy Powder Having Medium Particle Sizes

Second, alloy powder having medium particle sizes will be explained. With medium particle sizes (for example, particle sizes of more than 20 μm and 40 μm or less), an amorphous phase or a mixed phase of an amorphous phase and fine crystal phases is stably obtained by quenching, despite slight difficulty in quenching at a desired cooling speed as compared with the smaller particle sizes. In the alloy powder, the formation of $Fe_2B$ crystals is also suppressed. Fe-based, nanocrystalline alloy powder obtained by heat-treating the alloy powder having medium particle sizes has high permeability μi and excellent DC superimposition characteristics.

The alloy powder having medium particle sizes is, for example, alloy powder having particle sizes of more than 20 μm and 40 μm or less. This does not mean that the above effect cannot be obtained with the particle sizes of 20 μm or less or more than 40 μm. The particle sizes of more than 20 μm and 40 μm or less are a preferred example.

The alloy powder having medium particle sizes, for example, the alloy powder having particle sizes of more than 20 μm and 40 μm or less, can be obtained by classifying the alloy powder by a sieve. For example, magnetic cores formed by Fe-based, nanocrystalline alloy powder obtained by heat-treating the alloy powder having particle sizes of more than 20 μm can have high initial permeability μi. To provide the magnetic core with sufficiently high initial permeability pi, the particle sizes of the alloy powder is more preferably 22 μm or more, and further preferably 25 μm or more.

As the alloy powder having medium particle sizes, for example, alloy powder having particle sizes of 40 μm or less stably comprises an amorphous phase, or a mixed phase of an amorphous phase and fine crystal phases [(Fe—Si) bcc phases], with the formation of $Fe_2B$ crystals suppressed. To obtain such alloy powder, the particle sizes of the alloy powder is more preferably 38 μm or less, and further preferably 35 μm or less.

(3) Alloy Powder Having Adjusted Particle Sizes

The alloy powder can be classified by sieves to obtain, for example, powder having particle sizes, in which particle sizes of more than 40 μm are 10% or less by mass of the entire powder, particle sizes of more than 20 μm and 40 μm or less are 30% or more and 90% or less by mass of the entire powder, and particle sizes of 20 μm or less are 5% or more and 60% or less by mass of the entire powder. Because the alloy powder having particle sizes of more than 40 μm does not stably have an amorphous phase, or a mixed phase of an amorphous phase and fine crystal phases, the powder having particle sizes of more than 40 μm is preferably 10% or less by mass. The powder having particle sizes of more than 40 μm is more preferably 5% or less by mass, and most preferably 0% by mass.

The alloy powder having particle sizes of 20 μm or less easily provides an Fe-based, nanocrystalline alloy powder having a high saturation magnetic flux density Bs, which can suppress magnetic saturation even in high-frequency applications, and the alloy powder having particle sizes of more than 20 μm and 40 μm or less easily provides an Fe-based, nanocrystalline alloy powder suitable for magnetic cores having high initial permeability μi and excellent DC superimposition characteristics. Accordingly, desired magnetic properties can be obtained by properly setting a ratio of the powder having particle sizes of 20 jam or less to the powder having particle sizes of more than 20 μm and 40 μm or less.

With respect to the powder of 20 μm or less, its lower limit is preferably 10% by mass, and more preferably 20% by mass, and its upper limit is preferably 50% by mass, and more preferably 40% by mass. With respect to the powder having particle sizes of more than 20 μm and 40 μm or less, its lower limit is preferably 35% by mass, and more preferably 40% by mass, and its upper limit is preferably 85% by mass, and more preferably 80% by mass. With respect to the powder having particle sizes of 20 μm or less, its particle sizes are preferably 0.01 μm or more, further preferably 0.1 μm or more, and more preferably 1 μm or more.

[3] Fe-Based, Nanocrystalline Alloy Powder (1) Substantially Rectangular Structure Among the Fe-based, nanocrystalline alloy powder according to this embodiment, an Fe-based, nanocrystalline alloy powder obtained by heat-treating the alloy powder having relatively large particle sizes likely has substantially rectangular nanocrystalline structures. The alloy powder having relatively large particle sizes is, for example, alloy powder having intermediate particle sizes. Among them, the alloy powder having larger particle sizes particularly tends to provide substantially rectangular structures. Particularly, the alloy powder having particle sizes of more than 20 μm, further more than 30 jam, has remarkable tendency of providing substantially rectangular nanocrystalline structures.

Figure 4:
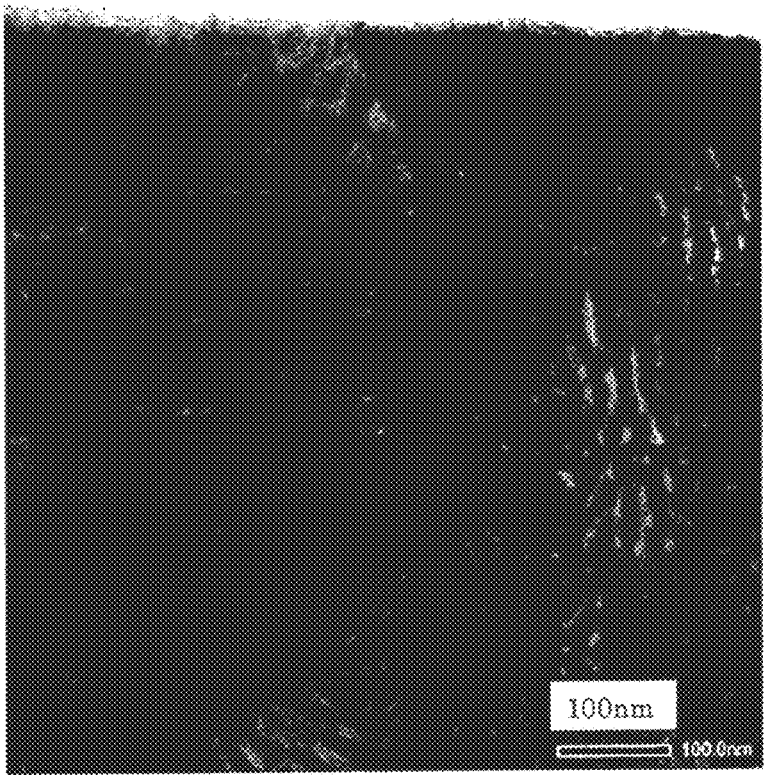
FIG. 4 is a transmission electron microscopic (TEM) photograph showing a cross section the Fe-based, nanocrystalline alloy powder after heat-treating the alloy powder of Example 21.

The substantially rectangular nanocrystalline structures (substantially rectangular structures) observed in the alloy structure of the Fe-based, nanocrystalline alloy powder according to this embodiment will be explained. FIG. 4 is a transmission electron microscopic (TEM) photograph showing the alloy structure of the Fe-based, nanocrystalline alloy powder according to this embodiment. In a lower left one-quarter field of FIG. 4, a stripe structure comprising black belts slantingly extending from upper left to lower right, and white-to-gray portions is observed. The black, belt-like, long portions are called substantially rectangular structures. There are large numbers of substantially rectangular structures extend substantially in parallel via white-to-gray portions. The substantially rectangular structures have longitudinal lengths of 20 nm or more and transverse widths of about 10-30 nm. In EDX analysis (also called EDS analysis) in the TEM observation, Fe and Si are detected in the substantially rectangular structures, and Fe and B are detected in the white-to-gray portions. These results suggest that the substantially rectangular structures are composed of (Fe—Si) bcc phases. The X-ray diffraction measurement has revealed that the white-to-gray portions (structures sandwiched by the substantially rectangular structures) are mainly amorphous partially with $Fe_2B$. Namely, it is presumed that the black, belt-like portions (substantially rectangular structures) are composed of nanocrystals, and the white-to-gray portions (structures sandwiched by the substantially rectangular structures) are amorphous (partially having $Fe_2B$).

Figure 5:
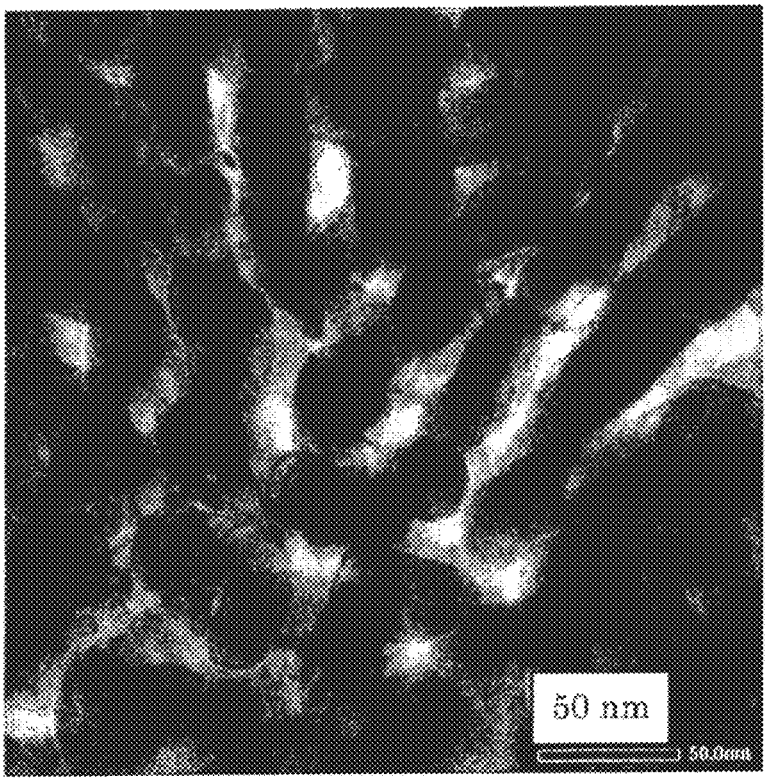
FIG. 5 is a transmission electron microscopic (TEM) photograph showing a cross section of the Fe-based, nanocrystalline alloy powder after heat-treating the alloy powder of Example 21, in a different field from that of FIG. 4.

In a center portion of FIG. 5, which is different from the portion of FIG. 4, substantially circular, black portions are observed. Because the substantially circular portions have diameters of 10-30 nm as large as the transverse widths of the substantially rectangular structures shown in FIG. 4, it is presumed that what is observed are the cross sections of the substantially rectangular structures shown in FIG. 4, which are substantially perpendicular to their extending directions. Namely, it is presumed from FIGS. 4 and 5 that the substantially rectangular structures are rod-shaped structures having substantially circular cross sections.

Though diffraction peaks of $Fe_2B$ crystals are observed in the X-ray diffraction (XRD) measurement as described above, extremely fine $Fe_2B$ crystals cannot be observed by a transmission electron microscope (TEM) having a magnification of about 300,000 times. Incidentally, TEM observation was conducted at acceleration voltage of 200 kVA.

In the alloy structure stably having substantially rectangular structures, the diffraction peak intensity of the (002) plane of $Fe_2B$, or the synthesized diffraction peak intensity of a (022) plane and a (130) plane of $Fe_2B$ is preferably 0.5% or more, and more preferably 1% or more, per 100% of the diffraction peak intensity of the (110) plane of the (Fe—Si) bcc phases.

Figure 7:
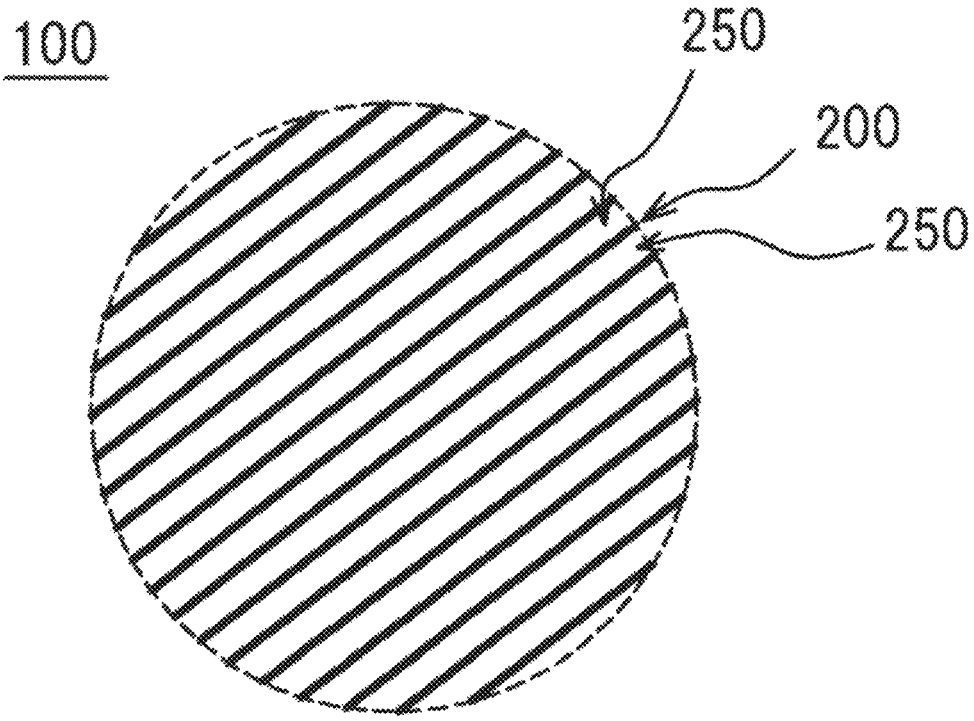
FIG. 7 is a schematic view for explaining the alloy structure of the heat-treated alloy powder according to the embodiment of the present invention.

FIG. 7 is a schematic view for explaining that the nanosized FeSi crystals have substantially rectangular structures. The nanocrystalline alloy 100 having substantially rectangular structures has a stripe-pattern structure in which substantially rectangular FeSi crystals 200 extend in parallel via amorphous phases 250 partially containing $Fe_2B$.

Figure 8:
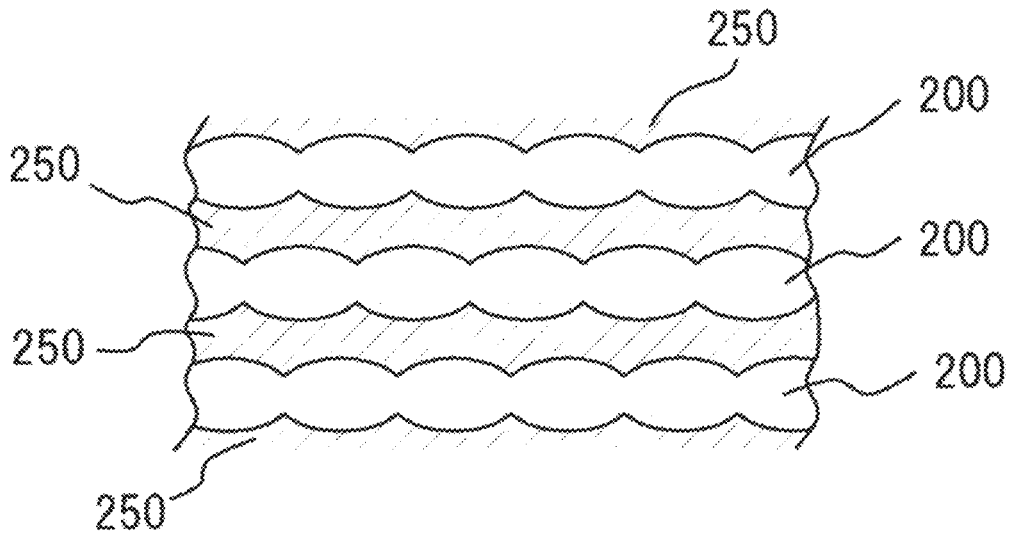
FIG. 8 is a schematic view for explaining the substantially rectangular structures of FeSi crystals in the alloy structure of FIG. 7.

FIG. 8 is a schematic view for explaining the structure of parallel line-shaped FeSi crystals 200 observed in the structure shown in FIG. 7. The substantially rectangular FeSi crystals 200 are in a rosary shape having large numbers of thin portions. Portions between the thin portions are in a substantially ellipsoidal shape, and pluralities of substantially ellipsoidal portions are connected to a substantially rectangular shape. The substantially ellipsoidal portions have minor axes of about 10 nm to 30 nm and major axes of 20 nm to 40 nm. The substantially rectangular FeSi crystals 200 have various lengths, for example, 20 nm or more, and long ones are as long as 200 nm or more. It is considered that their lengths vary depending on a stress distribution in the alloy structure. Incidentally, the conventional structures may be called granular structures below.

The conventional nanocrystalline structure comprising granular FeSi crystals has apparent crystal magnetic anisotropy of nearly zero as described above, exhibiting high sensibility to an external magnetic field. Magnetic cores formed by a nanocrystalline alloy having such crystal structure have high permeability and low loss.

On the other hand, in the new substantially rectangular structures, FeSi crystals are in a long columnar shape having larger longitudinal lengths than widths. Accordingly, their magnetic moment is likely oriented in the extending direction, with high sensibility to a magnetic field remaining because of their nano-order structure. Explaining the process of rotating the magnetic moment of Fe oriented in the easy magnetization direction by using a spring connected to the easy magnetization axis, it is considered that though the magnetic moment tends to rotate to become parallel with a perpendicular magnetic field because of high saturability to a magnetic field in the extending direction by balance between the orientation of the substantially rectangular FeSi crystals and their sensitivity to a magnetic field, the rotation of the magnetic moment is so restricted by the spring that the magnetic moment is quickly oriented in the easy magnetization direction when the magnetic field is removed. Due to the characteristics that a response of the magnetic moment to a magnetic field is linear, and that its high sensitivity to a magnetic field is kept up to a high magnetic field, it is considered that magnetic cores formed by nanocrystalline alloys having FeSi crystals of the substantially rectangular structures can exhibit large saturation magnetization due to FeSi crystals, and can keep high permeability increment $\mu\Delta$ in a range of up to large current (high magnetic field).

On the other hand, it is expected that the alloy structure containing FeSi crystals having the substantially rectangular structures has larger magnetic anisotropy than that of the alloy structure containing FeSi crystals having conventional granular structures, suffering increased coercivity, decreased permeability, and increased loss. To overcome such problems, the inventors have found that improved soft magnetic properties can be obtained by providing the alloy structure with pluralities of regions in which FeSi crystals have different extending directions, namely, by having a crystal structure in which the extending directions of FeSi crystals are aligned with regularity in each region, but different from one region to another, so that linear FeSi crystals are discontinuous between adjacent regions, with no regularity in the overall alloy.

The Fe-based, nanocrystalline alloy powder comprising FeSi crystals having substantially rectangular structures may partially contain other crystal phases than FeSi crystals to such an extent as not deteriorating magnetic properties needed for the alloy powder for magnetic cores. Other crystal phases than FeSi crystals are, for example, $Fe_2B$ crystals having high crystal magnetic anisotropy, which are considered as deteriorating the soft magnetic properties.

(2) Mechanism of Generating Substantially Rectangular Structures

The mechanism of generating the substantially rectangular structures in the nanocrystalline alloy has not been made clear, but it is considered that like FeSi crystals having conventional granular structures, FeSi crystals having substantially rectangular structures are precipitated (crystallized) in the amorphous phase with Cu clusters as starting points. It is thus found that though FeSi crystals having conventional granular structures are mostly formed from the amorphous phase by a heat treatment, FeSi crystals having substantially rectangular structures are formed in the cooling process of solidifying the melt to an alloy. In this respect, the formation of FeSi crystals having substantially rectangular structures is different from that of conventional nanocrystalline structures.

To form the substantially rectangular structures, the cooling speed and its distribution in the alloy (cooling speed gradient between the surface and center portions of alloy particles) in the production of the alloy are important. Though variable depending on the alloy composition, for example, it is necessary to cool the melt at a speed of about $10^{3}$° C./second or more, and to generate regions having different stress distributions in the inner portions of the alloy being cooled, to form an amorphous alloy. Particularly, the cooling speed at a temperature near 500° C. in the cooling process of the melt is influential.

(3) Heat Treatment

The Fe-based, nanocrystalline alloy powder according to the embodiment of the present invention is obtained by heat-treating the quenched alloy powder for nanocrystallization. The heat treatment conditions for nanocrystallization are as follows.

(a) Temperature-Elevating Speed (1) In the heat treatment necessary for nanocrystallization, the temperature-elevating speed of about 0.1-1000° C./second is preferable.

(2) In the batch-type heat treatment of a large amount of alloy powder, the temperature-elevating speed is preferably controlled to about 0.1-1° C./second, taking temperature elevation by exothermic nanocrystallization into consideration.

(3) In the continuous heat treatment of a small amount of alloy powder, the temperature-elevating speed is preferably controlled to 1-1000° C./second by adjusting the flow rate of the alloy powder.

(b) Keeping Temperature (Nanocrystallization Temperature)

The keeping temperature of the alloy, which is measured by differential scanning calorimetry (DSC) at a temperature-elevating speed of 20° C./minute, is preferably equal to or higher than a temperature at which the first exothermic peak by nanocrystallization (low temperature side) appears, and lower than a temperature at which the second exothermic peak by the precipitation of coarse crystals (high temperature side) appears. When a large amount of alloy powder is heat-treated in one batch, it is effective to carry out the heat treatment at a temperature within a range of the first exothermic peak ±about 30° C. (for example, 350-450° C.), taking the temperature-elevating speed and heat generation into consideration. When a small amount of alloy powder is continuously heat-treated, temperature elevation by heat generated by nanocrystallization need not be taken into consideration, so that the heat treatment at a temperature between the first exothermic peak and the second exothermic peak is effective.

(c) Keeping Time

When a large amount of alloy powder is heat-treated in one batch, the keeping time may be properly set depending on the amount of the alloy powder treated, because the alloy powder need only reach the above keeping temperature, and it is preferably 5-60 minutes depending on the temperature distribution and structure of a heat treatment facility. When a small amount of alloy powder is heat-treated continuously, the keeping temperature is set high as described above to accelerate crystallization, so that the keeping time may be short. The time period in which the alloy powder is kept at the highest temperature is preferably 1-300 seconds.

(d) Temperature-Lowering Speed

Because the temperature-lowering speed up to room temperature or near 100° C. has little influence on the magnetic properties of the alloy powder, it need not be controlled, but it may be, for example, 200-1000° C./hour, taking productivity into consideration.

(e) Heat Treatment Atmosphere

The heat treatment atmosphere is preferably a non-oxidizing atmosphere such as a nitrogen gas, etc.

The above heat treatment conditions can stably produce the Fe-based, nanocrystalline alloy powder with good reproducibility.

[4] Magnetic Core (1) Powder for Magnetic Core

By mixing new nanocrystalline alloy powder having substantially rectangular structures with conventional nanocrystalline alloy powder having granular structures and/or other soft magnetic material powder to utilize and supplement their different magnetic characteristics, powder forming magnetic cores exhibiting improved superimposition characteristics while suppressing increase in core loss and decrease in permeability can be obtained.

The other soft magnetic material powders include soft magnetic powders of amorphous Fe-based alloys, pure iron, and crystalline, soft magnetic metals such as Fe—Si, Fe—Si—Cr, etc.

(2) Production of Magnetic Core

The Fe-based, nanocrystalline alloy powder obtained by conducting classification if necessary and heat treatment as described above is mixed and blended with a binder such as a silicone resin, etc. and an organic solvent, and the organic solvent is evaporated to obtain granules. The granules are pressed to a desired core shape such as a toroidal shape, etc. in a pressing mold, to obtain a green body for a magnetic core. The green body is heated to cure the binder, forming a magnetic core.

The Fe-based, nanocrystalline alloy powder according to the embodiment of the present invention is suitable for compressed magnetic cores, or metal composite cores. In the case of the compressed magnetic core, for example, the Fe-based, nanocrystalline alloy powder is mixed with a binder acting as an insulating material and a bonding material. As the binder, epoxy resins, unsaturated polyester resins, phenol resins, xylene resins, diaryl phthalate resins, silicone resins, polyamideimides, polyimides, water glass, etc. may be used, though not restricted thereto. A mixture of the magnetic core powder and the binder is blended with a lubricant such as zinc stearate, etc., if necessary, and then charged into a molding die, and pressed to a compacted body having a desired shape under pressure of about 10 MPa to about 2 GPa by a hydraulic press machine, etc. The compacted body is then heat-treated at a temperature of 300° C. or higher and lower than the crystallization temperature for about 1 hour to remove strain and cure the binder, obtaining a compressed magnetic core. In this case, the heat treatment atmosphere may be an inert atmosphere or an oxidizing atmosphere. The compressed magnetic core may be in an annular shape such as a circular doughnut shape, a rectangular frame shape, etc., or a rod or plate shape, selectable depending on its applications.

The metal composite core may be produced by integral molding with a coil embedded in a mixture comprising the alloy powder and the binder. For example, by using a thermoplastic or thermosetting resin as the binder, a coil-embedded metal composite core (coil device) can easily be produced by a known molding method such as injection molding, etc. A mixture comprising the alloy powder and the binder may be formed into a sheet-shaped magnetic core by a known sheeting method such as a doctor blade method, etc. Also, a mixture comprising the magnetic core powder and the binder may be used as a shielding material.

In any case, the resultant magnetic core has excellent magnetic properties such as improved DC superimposition characteristics, suitable for inductors, noise filters, choke coils, transformers, reactors, etc.

(3) DC Superimposition Characteristics

With an insulated conductor wire wound in a predetermined number of turns around the magnetic core, and two ends of the conductor wire connected to an LCR meter and a DC current source, the inductance L can be measured at each bias current. With the length and cross section area of a magnetic path calculated from the shape of the magnetic core, the permeability μ can be determined from the above inductance L. With no DC bias current, the initial permeability μi (magnetic field intensity H=0) can be measured. With bias current generating a DC magnetic field having intensity H=10 kA/m, the permeability μ10 k can be measured.

The magnetic core according to the embodiment of the present invention has permeability μ10 k of preferably 14.1 or more, and more preferably 14.3 or more. μ10 k/μi, which is an index called permeability increment Δμ, is preferably 0.90 or more, more preferably 0.92 or more, and further preferably 0.93 or more. The initial permeability μi is preferably 9.0 or more, more preferably 10.0 or more, further preferably 11.0 or more, further preferably 12.0 or more, further preferably 13.0 or more, further preferably 14.0 or more, further preferably 15.0 or more, and most preferably 15.2 or more.

It is not clear why magnetic cores formed by the Fe-based, nanocrystalline alloy powder having an alloy structure containing the above substantially rectangular nanocrystalline structures have high initial permeability pi, and excellent DC superimposition characteristics, namely high μ10 k/μi, but it is presumed that the above substantially rectangular structures have different magnetization behavior from that of the conventional substantially granular nanocrystalline structures.

EXAMPLES

The present invention will be specifically explained by Examples below without intention of restriction.

(1) Examples 1-5, Reference Example 1, and Comparative Example 1

Element sources of pure iron, ferroboron, ferrosilicon, etc. were mixed to have each composition of Alloys A to E (Examples 1-5), Alloy A' (Reference Example 1), and Alloy F (Comparative Example 1) shown in Table 1, heated in an induction furnace at its melting point or higher to prepare a molten alloy melt, which was quenched by an apparatus (jet-atomizing apparatus) described in JP 2014-136807 A to obtain alloy powder containing nanocrystalline structures having an average crystal grain size of 10-50 nm in regions of 50% or more. The presumed temperature of a flame jet was 1300-1600° C., and the amount of water ejected was 4-5 liters/minute.

Among the resultant alloy powders, Alloys A to E (Examples 1-5) and Alloy F (Comparative Example 1) were classified by a sieve of 20 μm in opening size to remove powders having particle sizes of more than 20 μm, thereby obtaining alloy powders having particle sizes of 20 μm or less. As a result of X-ray diffraction (XRD) measurement, it was confirmed that each alloy powder of Examples 1-5 was composed of an amorphous phase (halo pattern), or a mixed phase of an amorphous phase and fine crystal phases [(Fe—Si) bcc peak]. The peaks (20=near 50° and 67°) of $Fe_2B$ were not observed. The (Fe—Si) bcc peak is a diffraction peak of the (110) plane of the (Fe—Si) bcc phases, and the peaks (20=near 50° and 67°) of $Fe_2B$ are a diffraction peak of the (002) plane of $Fe_2B$, and a synthesized diffraction peak of the (022) and (130) planes of $Fe_2B$.

Because the powder of the alloy A' (Reference Example 1) was not classified, it had nanocrystalline structures having an average crystal grain size of 10-50 nm in regions of 50% or more, and contained powders having particle sizes of more than 20 μm. In X-ray diffraction (XRD) measurement, the peaks (20=near 50° and 67°) of $Fe_2B$ were clearly observed in addition to an amorphous phase and fine crystal phases [(Fe—Si) bcc peak].

It was confirmed by the XRD measurement that the powder of Alloy F of Comparative Example 1 was composed of an amorphous phase.

Observation by a scanning electron microscope SEM having a magnification of 500 times revealed that the powders of Alloys A to E classified by the sieve of 20 μm in opening size were mostly spherical in the observed field. The term "mostly spherical" means that the powder shape includes an oval shape, etc. having a value of 1.25 or less, which is obtained by dividing the maximum diameter by the minimum diameter.

TABLE 1

| No. | Alloy | Alloy Composition (atomic %) |
|---|---|---|
| Example 1 | A | $Fe_{77.97}Cu_{1.18}Si_{3.96}B_{15.51}Cr_{0.97}C_{0.22}Sn_{0.19}$ |
| Ref. Ex. 1 | A' | $Fe_{77.97}Cu_{1.18}Si_{3.96}B_{15.51}Cr_{0.97}C_{0.22}Sn_{0.19}$ |
| Example 2 | B | $Fe_{79.40}Cu_{1.18}Si_{6.00}B_{12.00}Cr_{1.00}C_{0.22}Sn_{0.20}$ |
| Example 3 | C | $Fe_{79.28}Cu_{1.30}Si_{6.00}B_{12.00}Cr_{1.00}C_{0.22}Sn_{0.20}$ |
| Example 4 | D | $Fe_{79.57}Cu_{1.18}Si_{3.96}B_{13.90}Cr_{0.97}C_{0.20}Sn_{0.22}$ |
| Example 5 | E | $Fe_{79.41}Cu_{1.31}Si_{3.90}B_{14.2}Cr_{0.98}C_{0.10}Sn_{0.10}$ |
| Com. Ex. 1 | F | $Fe_{71.95}Cu_{0.99}Si_{13.70}B_{9.28}Nb_{2.97}C_{r0.99}C_{0.12}$ |

The alloy powders of Examples 1-5 and Reference Example 1 were subjected to a heat treatment comprising heating to 400° C. at an average temperature-elevating speed of 0.1-0.2° C./second, keeping a temperature of 400° C. for 30 minutes, and then cooling to room temperature over about 1 hour, to obtain Fe-based, nanocrystalline alloy powders.

The alloy powder of Comparative Example 1 was subjected to a heat treatment comprising temperature elevation to 480° C. at a temperature-elevating speed of 500° C./hour and to 480-540° C. at a temperature-elevating speed of 100° C./hour, keeping the temperature at 540° C. for 30 minutes, and then cooling to room temperature over about 1 hour, to obtain Fe-based, nanocrystalline alloy powder.

Figure 1B:
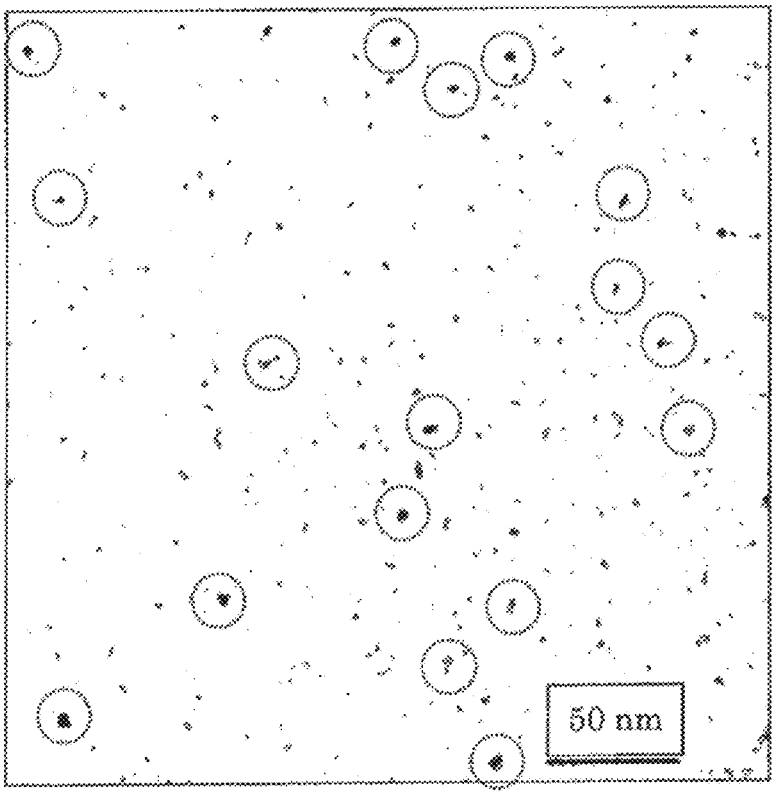

FIG. 1(*a*) is a transmission electron microscopic (TEM) photograph showing a cross section of the quenched powder having a particle size of 5 μm (before heat treatment) in Example 1, and FIG. 1(*b*) is a schematic view for explaining FIG. 1(*a*) in the same field. In the TEM photograph of FIG. 1(*a*), clusters of fine crystals of less than about 10 nm precipitated in the amorphous phase were observed in center portions of circles indicated in FIG. 1(*b*). Such a phase is called a mixed phase of an amorphous phase and fine crystal phases. Incidentally, other phases presumed as $Fe_2B$ were not observed.

Figure 2:
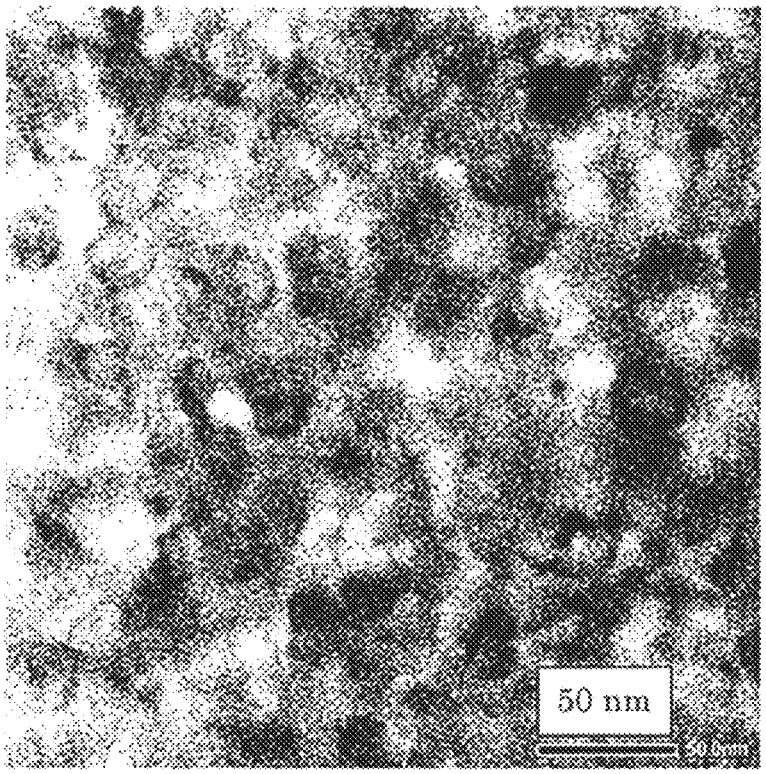
FIG. 2 is a transmission electron microscopic (TEM) photograph showing a cross section of the Fe-based, nanocrystalline alloy powder after heat-treating the powder of Alloy A of Example 1.

FIG. 2 is a transmission electron microscopic (TEM) photograph showing a cross section of the nanocrystalline alloy powder obtained by heat-treating the alloy powder of Example 1. In FIG. 2, substantially granular phases having crystal grain sizes of 15-25 nm were observed. After the heat treatment, too, other phases presumed as $Fe_2B$ were not observed. The average crystal grain size D of the nanocrystalline alloy powder (alloy A) of Example 1 determined by the Scherrer's equation was 19 nm. In 50% or more regions of the heat-treated nanocrystalline alloy powder of Example 1, too, alloy structures having a similar average crystal grain size were observed.

Figure 3:
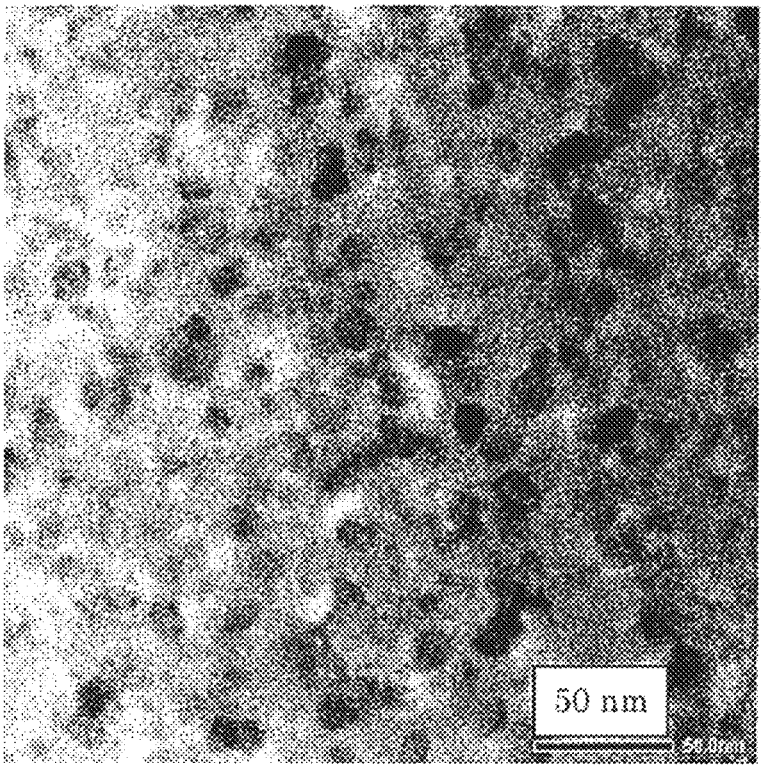
FIG. 3 is a transmission electron microscopic (TEM) photograph showing a cross section of the Fe-based, nanocrystalline alloy powder after heat-treating the powder of Alloy F of Comparative Example 2.

FIG. 3 is a transmission electron microscopic (TEM) photograph showing the heat-treated nanocrystalline alloy powder of Example 2. In FIG. 3, too, substantially granular phases having crystal grain sizes of about 20 nm are observed. As in Example 1, other phases presumed as $Fe_2B$ were not observed. The average crystal grain size D of the nanocrystalline alloy powder of Example 2 determined by the Scherrer's equation was 22 nm.

The average crystal grain sizes D of the heat-treated nanocrystalline alloy powders of Examples 3, 4 and 5 determined by the Scherrer's equation were 18 nm, 25 nm, and 16 nm, respectively.

In 50% or more regions of the heat-treated nanocrystalline alloy powders of Examples 2-5, too, alloy structures having similar average crystal grain sizes were observed.

The average crystal grain size was determined by the Scherrer's equation from a half width (radian) of a (Fe—Si) bcc peak (20=near 53°) in the X-ray diffraction (XRD) pattern of the heat-treated nanocrystalline alloy powder.

The average crystal grain size of the nanocrystalline powder of Alloy A' of Reference Example 1 determined by the Scherrer's equation was 20 nm, as large as that of Alloy A of Example 1. The intensities and shapes of $Fe_2B$ peaks observed in the X-ray diffraction (XRD) measurement did not differ before and after the heat treatment. In 50% or more regions of the heat-treated nanocrystalline alloy powder of Reference Example 1, too, alloy structures having similar average crystal grain sizes were observed.

The average crystal grain size of the nanocrystalline alloy powder of Comparative Example 1 determined by the Scherrer's equation was 10 nm.

In Examples 1-5 and Comparative Example 1, the X-ray diffraction (XRD) measurement was conducted by the following apparatus under the following conditions.

Apparatus: RINT2500PC available from Rigaku Corporation,

Measurement Conditions:

X-ray source: CoKα (wavelength λ=0.1789 nm),

Scanning axis: 2θ/θ,

Sampling interval: 0.020°,

Scanning speed: 2.0°/minute,

Divergence slit: ½°,

Vertical divergence slit: 5 mm,

Scattering slit: ½°,

Receiving slit: 0.3 mm,

Voltage: 40 kV, and

Current: 200 mA.

Measurement of High-Frequency Characteristics of Magnetic Cores Formed by Fe-Based, Nanocrystalline Alloy Powders Each Fe-based, nanocrystalline alloy powder of Example 1, Comparative Example 1 and Reference Example 1 was blended with a silicone resin (H44 available from Wacker Asahikasei Silicone Co., Ltd.) and ethanol at mass ratios of 100 (alloy powder), 5 (silicone resin), and 5.8 (ethanol), formed into granules by evaporating ethanol, and pressed under pressure of 1 MPa to obtain a magnetic core-shaped green body of 13.5 mm in outer diameter, 7 mm in inner diameter and 2 mm in height. The green body was then hardened by heating to form a magnetic core for measurement.

The loss P was measured by a B-H analyzer (SY-8218 available from Iwatsu Electric Co., Ltd.) at a frequency of 0.3-3 MHz. The measurement results of the loss P ($kW/m^3$) at frequencies of 1 MHz, 2 MHz and 3 MHz, respectively, and at a magnetic flux density B=0.02 T are shown in Table 2. A higher frequency leads to larger eddy current loss, resulting in larger loss P.

TABLE 2

| Loss P ($kW/m^3$) of Magnetic Core at B = 0.02 T | | | | |
|---|---|---|---|---|
| | | Frequency (MHz) | | |
| | | 1 | 2 | 3 |
| Example 1 | Alloy A | 760 | 1800 | 2907 |
| Com. Ex. 1 | Alloy F | 750 | 1900 | 3300 |
| Ref. Ex. 1 | Alloy A' | 1900 | 5000 | 8700 |

The comparison of the loss P at each frequency between Example 1 and Comparative Example 1 indicated that Example 1 exhibited smaller loss than that of Comparative Example 1 at frequencies of 2 MHz and 3 MHz, though both had the same loss P at a frequency of 1 MHz. Also, the comparison of the loss P at each frequency between Example 1 and Reference Example 1 indicated that the loss P of Reference Example 1 was 2.5 times as large as that of Example 1 at a frequency of 1 MHz. Similarly, the former was as large as 2.8 times at a frequency of 2 MHz, and as large as 3.0 times at a frequency of 3 MHz. It was found that the magnetic core formed by the alloy powder of Reference Example 1, which was not classified, suffered extremely large loss P. This is presumably because the magnetic properties (loss P) of the alloy powder of Reference Example 1 were deteriorated by $Fe_2B$ crystals observed in the XRD measurement.

Saturation Magnetic Flux Densities Bs of Fe-Based, Nanocrystalline Alloy Powders As the saturation magnetic flux density Bs of each Fe-based, nanocrystalline alloy powder of Examples 1-5 and Comparative Example 1, the maximum value of B in a B-H loop obtained by applying a magnetic field H of up to 800 kA/m in VSM available from Riken Denshi Co., Ltd. was used. The results are shown in Table 3. A magnetic core was formed by each Fe-based, nanocrystalline alloy powder of Examples 2-5 by the same method as in Example 1, and its core loss P was measured at a frequency of 3 MHz (magnetic flux density B=0.02 T). The results are also shown in Table 3.

TABLE 3

| No. | Alloy | Bs[1] (T) of Fe-Based, Nanocrystalline Alloy Powder | Loss P ($kW/m^3$) of Magnetic Core at 0.02 T and 3 MHz |
|---|---|---|---|
| Example 1 | A | 1.52 | 2907 |
| Example 2 | B | 1.60 | 3301 |
| Example 3 | C | 1.61 | 2834 |
| Example 4 | D | 1.59 | 3450 |
| Example 5 | E | 1.62 | 3220 |
| Com. Ex. 1 | F | 1.15 | 3300 |

Note:
[1]Bs represents saturation magnetic flux density.

The saturation magnetic flux density Bs was as high as 1.52-1.62 T in Examples 1-5, while it was as low as 1.15 T in Comparative Example 1. It is known that in a high-frequency range of several hundreds kHz or more, magnetic fluxes do not easily enter an inner portion of magnetic alloy powder, but flow on its surface only, which is called skin effect. Accordingly, in the case of magnetic alloy powder having a low saturation magnetic flux density Bs, magnetic fluxes are likely concentrated on the surface, for example, in a high-frequency range of several hundreds kHz or more, causing magnetic saturation. When magnetically saturated, the magnetic core looses a function as a magnetic body, resulting in extremely deteriorated characteristics.

Taking into consideration the skin effect described above, the reason why the losses P of Example 1 were lower than those of Comparative Example 1 at frequencies of 2 MHz and 3 MHz is presumably that the alloy powder of Example 1 having a higher saturation magnetic flux density Bs than that of Comparative Example 1 can avoid magnetic saturation on the surface in high-frequency range of 2 MHz or more.

The alloy powders of Examples 1-5 had saturation magnetic flux densities Bs (T) of 1.50 T or more (1.52-1.62 T), higher than that of Comparative Example 1 (1.15 T), and losses P of 2834-3450 $kW/m^3$ on the same level as that of Comparative Example 1.

As described above, because magnetic cores formed by the Fe-based, nanocrystalline alloy powders of the present invention have relatively high saturation magnetic flux densities Bs, their magnetic saturation can be suppressed in a frequency range of 2 MHz or more, so that they exhibit low losses in a high-frequency range of 2 MHz or more.

(2) Examples 21-25, Comparative Example 21, and Reference Example 2

Though the powders having particle sizes of 20 μm or less, which were classified by a sieve having an opening size of 20 μm, were used in Examples 1-5 and Comparative Example 1, powders having particle sizes of more than 20 μm were herein classified by a sieve having an opening size of 40 μm to remove powders having particle sizes of more than 40 μm, to obtain alloy powders having particle sizes of more than 20 μm and 40 μm or less. The same alloys as in Examples 1-5 were used in Examples 21-25, and the same alloy as in Comparative Example 1 was used in Comparative Example 21.

X-ray diffraction (XRD) measurement revealed that each alloy powder of Examples 21-25 was composed of an amorphous phase (halo pattern), or a mixed phase of an amorphous phase and fine crystal phases [(Fe—Si) bcc peak], the intensities of peaks (2θ=near 43° and 57°) of $Fe_2B$ being 3-13% of that of the (Fe—Si) bcc peak, indicating that the formation of $Fe_2B$ crystals was suppressed. Using an X-ray diffraction apparatus (Rigaku RINT-2000 available from Rigaku Corporation), the X-ray diffraction (XRD) measurement was conducted by continuous scanning under the conditions of an X-ray source of Cu-Kα, applied voltage of 40 kV, current of 100 mA, a divergence slit of 1°, a scattering slit of 1°, a receiving slit of 0.3 mm, a scanning speed of 2°/min, a scanning step of 0.02°, and a scanning range of 20–60°.

The observation of the alloy powders of Examples 21-25 by a scanning electron microscope SEM (500 times) revealed that the alloy powders were substantially spherical in the observed field. The term "substantially spherical" means that they are in an oval shape, etc., with a ratio of the major axis to the minor axis being 1.25 or less.

The alloy powder of Reference Example 2 having particle sizes of more than 40 μm was obtained by classifying the same alloy as in Example 1 (Example 21) by a sieve having an opening size of 40 μm to remove powder having particle sizes of 40 μm or less. X-ray diffraction (XRD) measurement revealed that Reference Example 2 was composed of a mixed phase of an amorphous phase and fine crystal phases [(Fe—Si) bcc peak], the intensities of peaks (20=near 43° and 57°) of $Fe_2B$ being 18% of that of the (Fe—Si) bcc peak. The above (Fe—Si) bcc phases exhibited a sharp peak. It is thus presumed that the alloy powder contained not fine crystals but relatively large crystals even before the heat treatment. The XRD measurement confirmed that the alloy powder of Comparative Example 21 was composed of an amorphous phase.

The alloy powders of Examples 21-25 and Reference Example 2 were subjected to a heat treatment comprising heating to 400° C. at an average temperature-elevating speed of 0.1-0.2° C./second, keeping a temperature of 400° C. for 30 minutes, and then cooling to room temperature over about 1 hour, to obtain Fe-based, nanocrystalline alloy powders.

The alloy powder of Comparative Example 21 was subjected to a heat treatment comprising temperature elevation to 480° C. at a temperature-elevating speed of 500° C./hour and to 480-540° C. at a temperature-elevating speed of 100° C./hour, keeping a temperature of 540° C. for 30 minutes, and then cooling to room temperature over about 1 hour, to obtain Fe-based, nanocrystalline alloy powder.

FIG. 4 is a transmission electron microscopic (TEM) photograph showing a cross section of the heat-treated Fe-based, nanocrystalline alloy powder of Example 21 (spherical powder having particle sizes of 28 μm, observed by SEM). Substantially rectangular structures are observed in the alloy structure of the Fe-based, nanocrystalline alloy powder of Example 21. The substantially rectangular structures have various lengths, for example, 20 nm or more.

FIG. 5 is a transmission electron microscopic (TEM) photograph showing another cross section of the heat-treated Fe-based, nanocrystalline alloy powder (spherical powder having particle sizes of 28 μm, observed by SEM) of Example 21. It is observed in FIG. 5 that the cross sections of the substantially rectangular structures substantially perpendicular to their extending directions have diameters of 10-30 nm.

Nanocrystals in Examples 21-25 had average particle sizes D of 30 nm, 25 nm, 20 nm, 21 nm, and 23 nm, respectively. Also, alloy structures having similar average crystal grain sizes were observed in 50% or more regions of the heat-treated nanocrystalline alloy powders of Examples 21-25.

Figure 6:
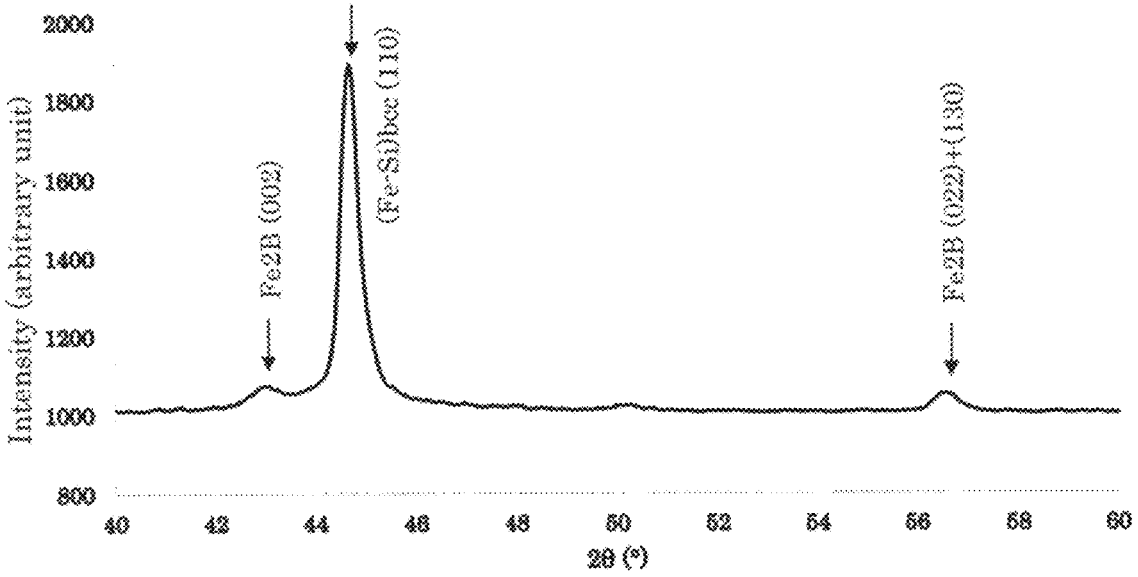
FIG. 6 is a graph showing an X-ray diffraction (XRD) pattern of the alloy of Example 21 after heat treatment.

FIG. 6 shows an X-ray diffraction (XRD) pattern of the heat-treated Fe-based, nanocrystalline alloy powder of Example 21, in which a (Fe—Si) bcc peak and $Fe_2B$ peaks are observed. It is presumed from their intensity (peak area) ratios and EDX analysis results in TEM observation that the peak of nanocrystals having substantially rectangular structures corresponds to the (Fe—Si) bcc peak, and that the peaks of different structures from the substantially rectangular structures correspond to those of $Fe_2B$. It is also presumed that there is an amorphous phase exhibiting halo in addition to the substantially rectangular structures.

As described above, in the quenched alloy powder of the present invention, the X-ray diffraction (XRD) peak intensity of $Fe_2B$ is 5% or less of that of the (Fe—Si) bcc phases, indicating that the formation of $Fe_2B$ crystals is suppressed. In the heat-treated Fe-based, nanocrystalline alloy powder, the $Fe_2B$ diffraction peak does not change by the heat treatment, because the heat treatment temperature is lower than a temperature at which $Fe_2B$ crystals increase or grow. On the other hand, because part of the halo-generating amorphous phase is nanocrystallized by the heat treatment, the diffraction peak intensity of the (Fe—Si) bcc phases tends to become higher. Accordingly, a ratio of the diffraction peak intensity of the (002) plane of $Fe_2B$, or the synthesized diffraction peak intensity of the (022) and (130) planes of $Fe_2B$ to the diffraction peak intensity (100%) of the (110) plane of the (Fe—Si) bcc phases tends to become slightly lower than before the heat treatment.

When the diffraction peak intensity of the (002) plane of $Fe_2B$, or the synthesized diffraction peak intensity of the (022) and (130) planes of $Fe_2B$ is 15% or less of the diffraction peak intensity (100%) of the (110) plane of the (Fe—Si) bcc phases, the formation of $Fe_2B$ crystals is suppressed in the alloy powder. The diffraction peak intensity of $Fe_2B$ is more preferably 10% or less, and further preferably 5% or less.

In the X-ray diffraction (XRD) pattern shown in FIG. 6, the diffraction peak intensity of the (002) plane of $Fe_2B$ is about 8%, and the synthesized diffraction peak intensity of the (022) and (130) planes of $Fe_2B$ is also about 8%, relative to the diffraction peak intensity (100%) of the (110) plane of the (Fe—Si) bcc phases.

The average crystal grain size of the nanocrystalline alloy powder of Comparative Example 21 determined by the Scherrer's equation was 10 nm. Also, there were no substantially rectangular structures in TEM observation.

Measurement of DC Superimposition Characteristics of Magnetic Cores Formed by Fe-Based, Nanocrystalline Alloy Powders Each of the nanocrystalline alloy powders of Examples 21-25 and Comparative Example 21 obtained by heat-treating the alloy powders having particle sizes of more than 20 μm and 40 μm or less was blended with a silicone resin (H44 available from Wacker Asahikasei Silicone Co., Ltd.) and ethanol, at mass ratio of 100 (alloy powder), 5 (silicone resin) and 5.8 (ethanol), formed into granules by evaporating ethanol, and pressed under pressure of 1 MPa to obtain a core-shaped green body of 13.5 mm in outer diameter, 7 mm in inner diameter and 2 mm in height. This green body was hardened by heating to obtain a magnetic core for measurement. The nanocrystalline alloy powders of Example 1 and Reference Example 2 were also formed into magnetic cores for measurement.

30 turns of an insulated conductor wire having a diameter of 0.7 mm was wound around each of the above magnetic cores. Two ends of the wound insulated conductor wire were connected to an LCR meter (4284A available from Agilent Technologies Japan, Ltd.) and a bias current source (4184A available from Agilent Technologies Japan, Ltd.), and the inductance L (H) was measured with DC current $I_{DC}$ of 0 A and 10.5 A superimposed, under the conditions of applied voltage of 1 V, and a frequency of 100 kHz. With the superimposition of DC current of 10.5 A, a DC magnetic field (intensity H=10 kA/m) is generated.

The length (m) and cross section area ($m^2$) of the magnetic path were calculated from the shape of the magnetic core.

The permeability μ was determined by the formula of permeability μ=[L (H)×magnetic path length (m)]/[4π×$10^{-7}$×cross section area ($m^2$)×(number of turns: 30 turns)], wherein (4π×$10^{-7}$) is permeability $\mu_0$ (unit: H/m) of vacuum.

The initial permeability μi was determined at $I_{DC}$=0, and the permeability μ10 k was determined at $I_{DC}$=10.5. The results are shown in Table 4 together with ratios μ10 k/μi of permeability μ10 k to initial permeability μi.

TABLE 4

| No. | μi | μ10k | μ10k/μi |
|---|---|---|---|
| Example 21 | 17.1 | 15.9 | 0.93 |
| Example 1 | 12.1 | 11.4 | 0.94 |
| Ref. Ex. 2 | 11.7 | 11.0 | 0.94 |
| Example 22 | 16.5 | 15.5 | 0.94 |
| Example 23 | 16.6 | 15.5 | 0.93 |
| Example 24 | 15.4 | 14.4 | 0.94 |
| Example 25 | 15.5 | 14.6 | 0.94 |
| Com. Ex. 21 | 14.7 | 11.2 | 0.76 |

While the μi was 15.4 or more in Examples 21-25, it was as low as 12.1, 11.7 and 14.7, respectively, less than 15.0, in Example 1, Reference Example 2 and Comparative Example 21. While the μ10 k was 14.4 or more in Examples 21-25, it was as low as 11.4, 11.0 and 11.2, respectively, less than 14.1, in Example 1, Reference Example 2 and Comparative Example 21. The μ10 k/μi in Examples 21-25 was 0.90 or more (0.93-0.94). The μ10 k/μi in Example 1 and Reference Example 2 was as large as 0.94 because of low μi. The μ10 k/μi in Comparative Example 21 was as small as 0.76. As described above, because Examples 21-25 had high μi of 15.4 or more and high μ10 kA of 14.4 or more, their μ10 k/μi was 0.90 or more (0.93-0.94).

Though the permeability is lower in Example 1 than in Examples 21-25, Example 1 is advantageous in a high saturation magnetic flux density as described above. Thus, the Fe-based, nanocrystalline alloy powder of the present invention having excellent magnetic properties though variable depending on its particle sizes can be used for different applications of desired characteristics.

(3) Examples 31-37

Element sources of pure iron, ferroboron, ferrosilicon, etc. were mixed to have each composition of Alloys C and G to L (Examples 31-37) shown in Table 5, heated to its melting point or higher in an induction furnace, to prepare a molten alloy melt, which was quenched by the apparatus (jet-atomizing apparatus) described in JP 2014-136807 A, to obtain alloy powder having an average crystal grain size of 10-50 nm in 50% or more regions. The presumed temperature of the flame jet was 1300-1600° C., and the amount of water ejected was 4-5 liters/minute. The resultant alloy powder was classified by a sieve having an opening size of 32 μm to remove powder having particle sizes of more than 32 μm, thereby obtaining alloy powder having particle sizes of 32 μm or less.

The same X-ray diffraction (XRD) measurement as in Example 1 confirmed that each of the alloy powders of Examples 31-37 had an alloy structure composed of an amorphous phase (halo pattern), or a mixed phase of an amorphous phase and fine crystal phases [(Fe—Si) bcc peak]. Also, the X-ray diffraction (XRD) measurement of the quenched alloy powder confirmed that the diffraction peak intensity of the (002) plane of $Fe_2B$, or the synthesized diffraction peak intensity of the (022) and (130) planes of $Fe_2B$ were both 15% or less of the diffraction peak intensity (100%) of the (110) plane of the (Fe—Si) bcc phases, indicating that the formation of $Fe_2B$ crystals was suppressed.

The observation by a scanning electron microscope SEM having a magnification of 500 times revealed that the alloy powders of Examples 31-37 were substantially spherical.

TABLE 5

| No. | Alloy | Alloy Composition (atomic %) |
|---|---|---|
| Example 31 (1) | C | $Fe_{79.28}Cu_{1.30}Si_{6.00}B_{12.00}Cr_{1.00}C_{0.22}Sn_{0.20}$ |
| Example 32 | G | $Fe_{78.40}Cu_{1.20}Si_{2.00}B_{17.00}Cr_{1.00}C_{0.20}Sn_{0.20}$ |
| Example 33 | H | $Fe_{79.20}Cu_{0.80}Si_{6.00}B_{12.00}Cr_{1.00}C_{0.20}Sn_{0.80}$ |
| Example 34 | I | $Fe_{79.30}Cu_{1.00}Si_{6.00}B_{12.00}Cr_{1.00}C_{0.20}Sn_{0.50}$ |
| Example 35 | J | $Fe_{80.20}Cu_{1.20}Si_{6.00}B_{12.00}Cr_{0.10}C_{0.20}Sn_{0.30}$ |
| Example 36 | K | $Fe_{79.80}Cu_{1.20}Si_{6.00}B_{12.00}Cr_{0.50}C_{0.20}Sn_{0.30}$ |
| Example 37 | L | $Fe_{78.80}Cu_{1.20}Si_{6.00}B_{12.00}Cr_{1.50}C_{0.20}Sn_{0.30}$ |

Note:
(1) The same composition as in Example 3.

Each of the alloy powders of Examples 31-37 was subjected to a heat treatment comprising heating to 400° C. at an average temperature-elevating speed of 0.1-0.2° C./second, keeping a temperature of 400° C. for 30 minutes, and then cooling to room temperature over about 1 hour. By this heat treatment, an Fe-based, nanocrystalline alloy powder having an average crystal grain size of 10-50 nm was obtained. SEM observation revealed that each Fe-based, nanocrystalline alloy powder of Examples 31-37 had the same substantially rectangular structures as in Example 21.

Measurement of DC Superimposition Characteristics of Magnetic Cores Using Fe-Based, Nanocrystalline Alloy Powders Each of the Fe-based, nanocrystalline alloy powders of Examples 31-37 was blended with a silicone resin and ethanol, formed into granules by evaporating ethanol, and pressed to a green body in the same manner as in Example 21. This green body was hardened by heating to obtain a magnetic core for measurement.

The initial permeability μi, permeability μ10 k, and μ10 k/μi of each magnetic core were measured in the same manner as in Example 21. The results are shown in Table 6.

TABLE 6

| No. | μi | μ10k | μ10k/μi |
|---|---|---|---|
| Example 31 | 9.74 | 9.54 | 0.98 |
| Example 32 | 13.1 | 12.3 | 0.94 |
| Example 33 | 12.3 | 11.5 | 0.94 |
| Example 34 | 12.9 | 12.1 | 0.94 |
| Example 35 | 13.4 | 12.3 | 0.92 |
| Example 36 | 14.2 | 12.9 | 0.91 |
| Example 37 | 14.3 | 13.0 | 0.91 |

Any magnetic core of Examples 31-37 had μ10 k/μi of 0.90 or more (0.91-0.98). The magnetic core of Example 31 had as large μ10 k/μi as 0.98, because of low μi. Because the magnetic cores of Examples 32-37 had as high μi as 10 or more (12.3-14.3) and higher μ10 k of 11 or more (11.5-13.0), their μ10 k/μi was 0.90 or more. Incidentally, the μi was from 9.74 to 14.3, which were 9 or more.

Measurement of High-Frequency Characteristics of Magnetic Cores Using Fe-Based, Nanocrystalline Alloy Powders The losses P of these magnetic cores were measured. Table 7 shows the losses P (kW/m$^3$) at frequencies of 1 MHz, 2 MHz, and 3 MHz, and a magnetic flux density B=0.02 T. Usually, a higher frequency leads to increased eddy current loss, resulting in larger loss P.

The magnetic cores of Examples 31-37 are practically usable despite larger losses P than that of the magnetic core of Example 1. The magnetic core of Example 36 having the Cr content of 0.50 atomic % had lower loss P than those of the magnetic core of Example 35 having the Cr content of 0.10 atomic % and the magnetic core of Example 37 having the Cr content of 1.50 atomic %.

TABLE 7

Loss P (kW/m$^3$) of Magnetic Core at B = 0.02 T

| | | Frequency (MHz) | | |
|---|---|---|---|---|
| | | 1 | 2 | 3 |
| Example 31 | Alloy C | 1253 | 2749 | 4681 |
| Example 32 | Alloy G | 1050 | 2366 | 3965 |
| Example 33 | Alloy H | 1142 | 2479 | — (1) |
| Example 34 | Alloy I | 919 | 2014 | — (1) |
| Example 35 | Alloy J | 1334 | 3254 | 5652 |
| Example 36 | Alloy K | 1269 | 3086 | 5365 |
| Example 37 | Alloy L | 1454 | 3595 | 6412 |
| Ref. Ex. 1 | Alloy A' | 1900 | 5000 | 8700 |

Note:
(1) "—" means "not measured."

Saturation Magnetic Flux Density Bs of Fe-Based, Nanocrystalline Alloy Powder

As the saturation magnetic flux density Bs of each Fe-based, nanocrystalline alloy powder of Examples 31-37, the maximum B in a B-H loop obtained by applying a magnetic field H of up to 800 kA/m in VSM available from Riken Denshi Co., Ltd. was used. The results are shown in Table 8.

The saturation magnetic flux densities of Examples 31-37 were 1.47-1.59 T, higher than that of Comparative Example 1.

TABLE 8

| No. | Alloy | Bs(1) (T) of Alloy Powder |
|---|---|---|
| Example 31 | C | 1.47 |
| Example 32 | G | 1.55 |
| Example 33 | H | 1.53 |
| Example 34 | I | 1.54 |
| Example 35 | J | 1.59 |
| Example 36 | K | 1.57 |
| Example 37 | L | 1.52 |
| Com. Ex. 1 | F | 1.15 |

Note:
(1)Bs represents a saturation magnetic flux density.

(4) Examples 41 and 42 and Reference Example 41

Element sources of pure iron, ferroboron, ferrosilicon, etc. were formulated to have each composition of Fe, Cu, Si, B, Nb, Cr, Sn and C in Alloys M and N below after atomizing, charged into an alumina crucible, evacuated in a vacuum chamber of a high-frequency induction heating apparatus, and melted by high-frequency induction heating in an inert atmosphere (Ar) of reduced pressure. The melt was then cooled to form two types of alloy ingots.

Alloy Composition:

Alloy M: $Fe_{bal.}Cu_{1.2}Si_{4.0}B_{15.5}Cr_{1.0}Sn_{0.2}C_{0.2}$, and

Alloy N: $Fe_{bal.}\ Cu_{1.0}Si_{1.35}B_{11.0}Nb_{3.0}Cr_{1.0}$.

Each ingot was remelted, and the resultant melt was disintegrated by a high-speed flame-atomizing method. An atomizing apparatus used comprises a container for a molten metal, a melt-ejecting nozzle penetrating a center portion of a bottom of the container, jet burners (available from Hard Industry) each spraying a flame jet toward the molten metal flowing downward from the melt-ejecting nozzle, and means for cooling the disintegrated melt. The flame jet can disintegrate the molten metal to form molten metal powder, and each jet burner ejects a flame at a speed near ultrasonic or sonic speed. The cooling means comprises pluralities of cooling nozzles capable of ejecting a cooling medium toward the disintegrated molten metal. The cooling medium may be water, liquid nitrogen, liquefied carbon dioxide, etc.

The temperature of the ejected flame jet was 1300° C., and the flowing speed of the molten metal was 5 kg/min Using water as the cooling medium, water mist was sprayed from the cooling nozzles. The cooling speed of the molten metal was controlled by the amount of water sprayed (4.5-7.5 liters/min).

Each of the resultant powders of Alloys M and N was classified by a centrifugal aero-classifier (TC-15 available from Nisshin Engineering Inc.), to obtain two types of magnetic core powders of Alloy M having different average particle sizes d50 (the powder of Example 41 had a larger average particle size d50, and the powder of Example 42 had a smaller average particle size d50), and one type of magnetic core powder of Alloy N (the powder of Reference Example 41). X-ray diffraction (XRD) measurement under the conditions described below confirmed that the magnetic core alloy powders of Examples 41 and 42 exhibited diffraction peak of FeSi crystals having the bcc structure and diffraction peaks of $Fe_2B$ crystals having the bcc structure, while the magnetic core alloy powder of Reference Example 41 exhibited only a halo pattern with FeSi crystals and $Fe_2B$ crystals not observed. Also, TEM observation confirmed that the powders of Examples 41 and 42 had stripe structures (substantially rectangular structures) composed of parallel, substantially rectangular FeSi crystals.

100 g of each magnetic core alloy powder of Examples 41 and 42 and Reference Example 41 was charged into a SUS container of an electric heat treatment furnace whose atmosphere was adjustable, and heat-treated in an $N_2$ atmosphere having an oxygen concentration of 0.5% or less. The heat treatment was conducted by elevating the temperature at a speed of 0.006° C./second to the keeping temperature shown in Table 9, keeping this keeping temperature for 1 hour, and then stopping the heating to leave the furnace to be cooled.

Each heat-treated powder was evaluated with respect to particle sizes, saturation magnetization, coercivity and X-ray diffraction spectrum by the following methods.

Particle Sizes of Powders

Figure 9:
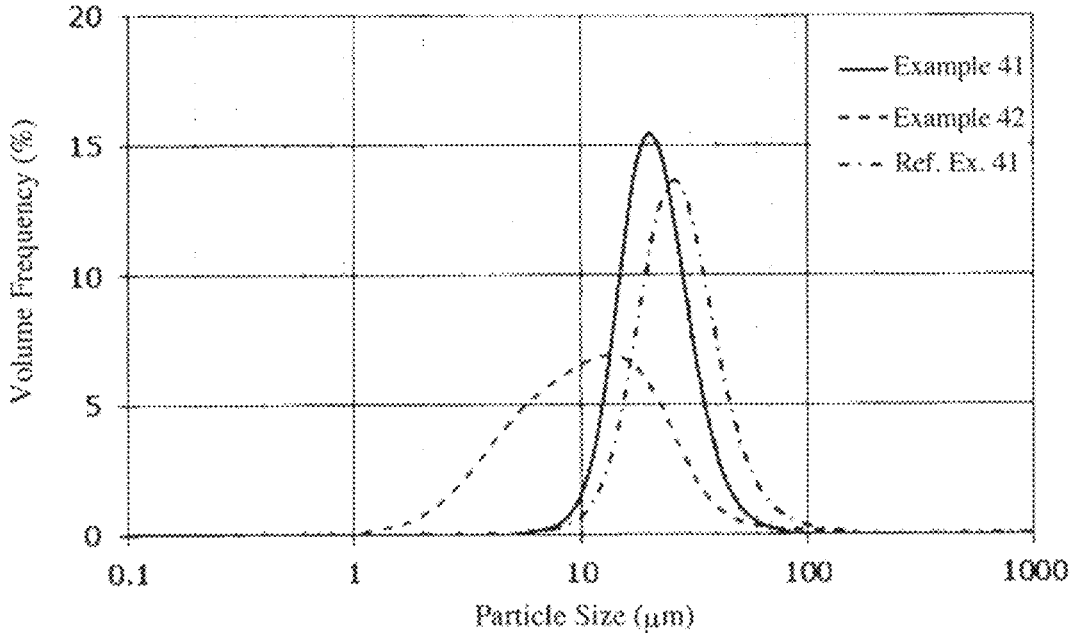
FIG. 9 is a graph showing particle size distributions of the alloy powders of Examples 41 and 42 and Reference Example 41.

The particle sizes of the powders were measured by a laser diffraction and scattering particle size distribution meter (LA-920 available from Horiba, Ltd.). The particle sizes d10, d50 and d90 corresponding to the cumulative percentages of 10% by volume, 50% by volume, and 90% by volume, respectively, were determined from a volume-based particle size distribution from the smaller diameter side, which was measured by a laser diffraction method. FIG. 9 shows the particle size distributions of the powders of Examples 41 and 42 and Reference Example 41.

Saturation Magnetization and Coercivity

The magnetization of each powder sample in the container was measured by a vibrating sample magnetometer VSM (VSM-5 available from Toei Industry Co., Ltd.), to determine saturation magnetization at a magnetic field intensity Hm of 800 kA/m and coercivity at Hm of 40 kA/m from the hysteresis loop.

Diffraction Spectrum

Figure 10:
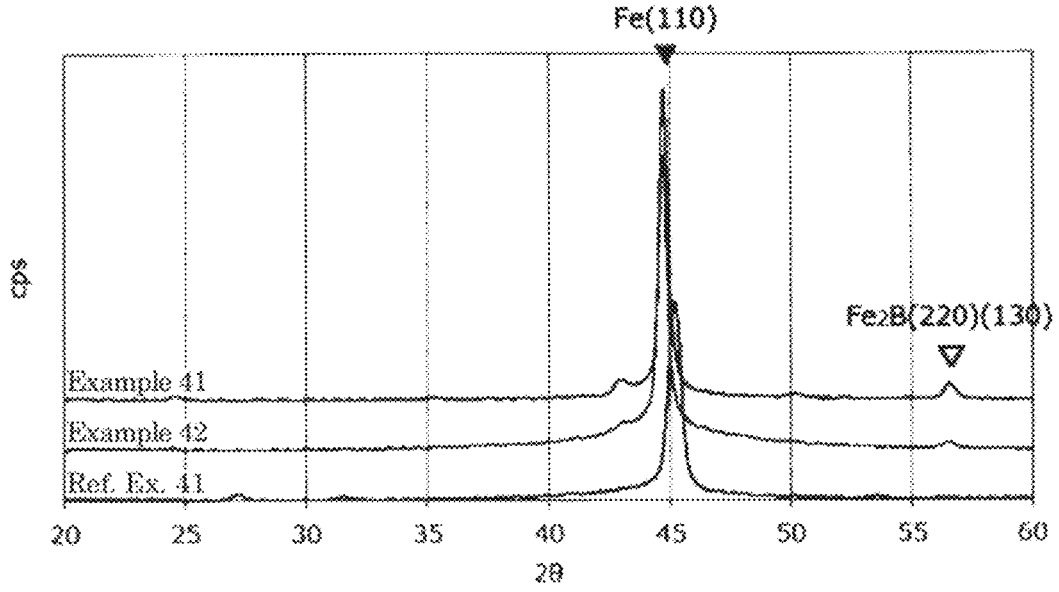
FIG. 10 is a graph showing the X-ray diffraction spectra of the alloy powders of Examples 41 and 42 and Reference Example 41.

Using an X-ray diffraction apparatus (Rigaku RINT-2000 available from Rigaku Corporation), an X-ray diffraction spectrum was obtained to determine the diffraction peak intensity P1 of FeSi crystals having a bcc structure at 2θ of around 45°, and the diffraction peak intensity P2 of $Fe_2B$ crystals having a bcc structure at 2θ of around 56.5°, thereby calculating a peak intensity ratio (P2/P1). The X-ray diffraction intensity measurement conditions were an X-ray source of Cu-Kα, applied voltage of 40 kV, current of 100 mA, a divergence slit of 1°, a scattering slit of 1°, a receiving slit of 0.3 mm, and continuous scanning at a scanning speed of 2°/min, a scanning step of 0.02°, and a scanning range of 20–60°. FIG. 10 shows the diffraction spectra of the powders of Examples 41 and 42 and Reference Example 41.

Figure 11:
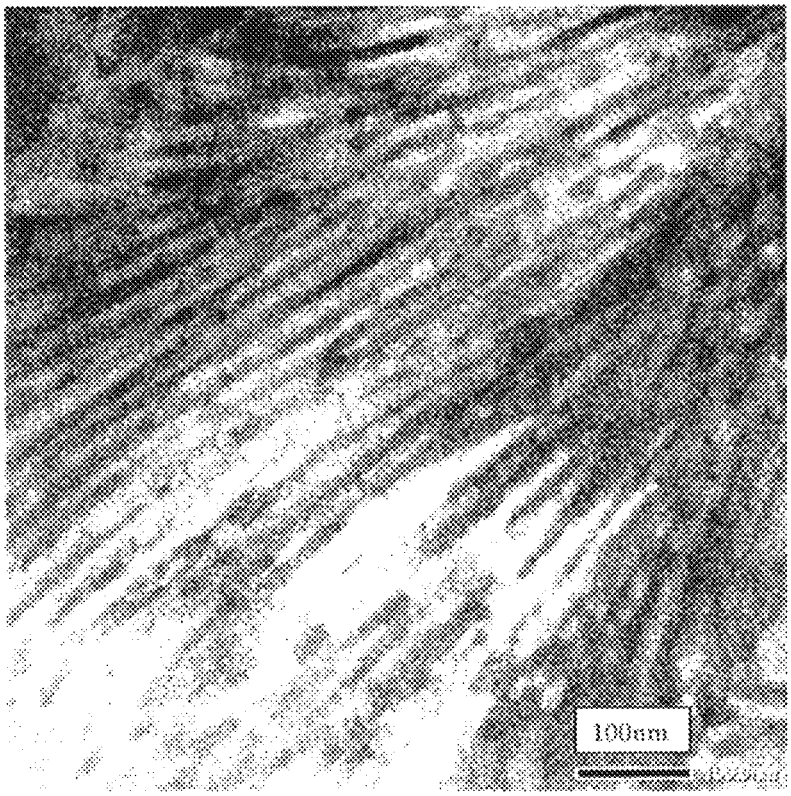
FIG. 11 is a TEM photograph showing a cross section of the particle of Example 41 having a particle size corresponding to d90.
Figure 12:
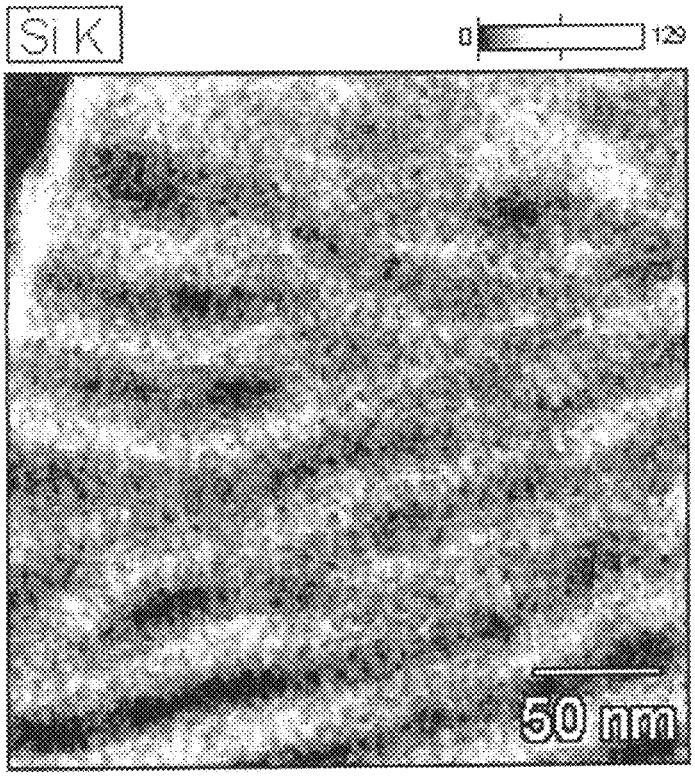
FIG. 12 is a mapping photograph of a Si (silicon) element in a cross section of the particle of Example 41 having a particle size corresponding to d90.
Figure 13:
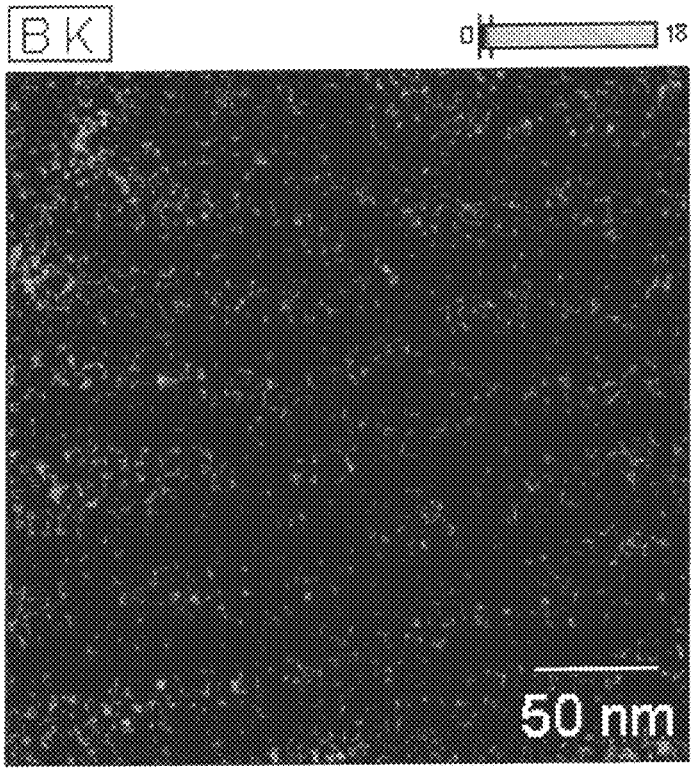
FIG. 13 is a mapping photograph of a B (boron) element in a cross section of the particle of Example 41 having a particle size corresponding to d90.
Figure 14:
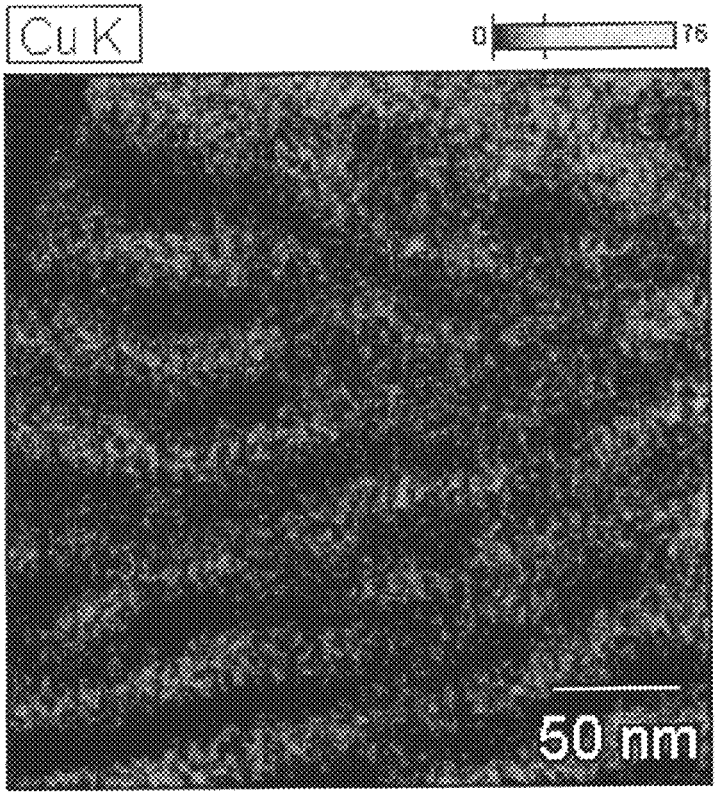
FIG. 14 is a mapping photograph of a Cu (copper) element in a cross section of the particle of Example 41 having a particle size corresponding to d90.

Pluralities of particles having particle sizes corresponding to d10 and d90 were selected from the heat-treated powders of Examples 41 and 42 and Reference Example 41, embedded in a resin, and cut and polished to expose their cross sections, which were observed by a TEM/EDX (transmission electron microscope/energy dispersive X-ray spectroscope). FIG. 11 is a TEM photograph showing a polished cross section of the particle of Example 41 corresponding to d90. FIG. 12 is a mapping photograph of Si (silicon) in another field of a cross section of the particle of Example 41 corresponding to d90, FIG. 13 is a mapping photograph of B (boron), and FIG. 14 is a mapping photograph of Cu (copper). The results are shown in Table 9.

TABLE 9

| No. | Alloy Composition | Particle Size (μm) d10 | d50 | d90 | Keeping Temperature (° C.) |
|---|---|---|---|---|---|
| Example 41 | M | 12.4 | 19.4 | 31.6 | 400 |
| Example 42 | M | 3.5 | 10.0 | 24.5 | 400 |
| Ref. Ex. 41 | N | 14.9 | 24.7 | 43.5 | 585 |

| No. | Peak Intensity Ratio (P2/P1) | Saturation Magnetization (emu/g) | Coercivity (A/m) | Existence of Substantially Rectangular Structures |
|---|---|---|---|---|
| Example 41 | 0.054 | 169 | 728 | Yes |
| Example 42 | 0.027 | 167 | 202 | Yes |
| Ref. Ex. 41 | — | 115 | 21 | No |

Substantially rectangular structures (stripe structures) having alternately dark and bright, parallel, linear portions were observed in a field of FIG. 11. It was identified by spot diffraction measurement by TEM and composition mapping that dark linear portions were FeSi crystals, and bright portions were amorphous phases. Stripe regions, and dark dot regions, etc. were observed in another field (not shown), as shown in FIGS. 4 and 5. In any region, dark portions were FeSi crystals, and bright portions were amorphous phases. Further detailed observation revealed that in any region, FeSi crystals were in linear shapes, which looked stripes or dots depending on their directions on the observation surface. Namely, one particle had FeSi crystals extending in different directions from one region to another, and each region had substantially rectangular structures in which FeSi crystals were crystallized in substantially one direction. Linear FeSi crystals had regularity with extending directions aligned in one region, but the extending directions of FeSi crystals differed from one region to another, resulting in the discontinuity of linear FeSi crystals between adjacent regions. As a result, the overall structure of the particle does not have regularity.

In the element distribution mapping, brighter portions contain more elements detected. FIGS. 12-14 showing the mapping of Si, B and Cu in the same field confirmed that Si and Cu were concentrated in regions corresponding to linear FeSi crystals, and B was concentrated in regions corresponding to amorphous phases between the linear FeSi crystals. It was also confirmed that all regions contained Fe (not shown), and that its concentration was higher in regions in which Si and Cu were concentrated.

It is considered that Fe and Si are used to form FeSi crystals by the spinodal decomposition of linear FeSi crystals and the amorphous phase, so that B not easily entering crystal phases is concentrated in the amorphous phases, resulting in phase separation by which the concentration of B in the amorphous phases is relatively high, leading to structures having periodically modulated concentrations.

The observation of pluralities of particles having particle sizes corresponding to d90 revealed that the powder of Example 42 had regions having striped, substantially rectangular structures like the structures observed in FIGS. 11, 4 and 5, while the powder of Reference Example 41 did not have regions having striped, substantially rectangular structures, but had conventional granular structures in which FeSi crystal grains of about 30 nm were dispersed in the amorphous phase.

The observation of pluralities of particles having particle sizes corresponding to d10 revealed that any particle in the powders of Examples 41 and 42 and Reference Example 41 had conventional granular structures. It was thus found that the magnetic core alloy powders of Examples 41 and 42 and Reference Example 41 were mixtures of nanocrystalline alloy particles having a granular structure and nanocrystalline alloy particles having substantially rectangular structures. On the other hand, the powder of Reference Example 41 was composed of conventional nanocrystalline alloy particles having granular structures without containing nanocrystalline alloy particles having substantially rectangular structures.

In the nanocrystalline alloy particles having substantially rectangular structures, $Fe_2B$ crystals are easily formed in the amorphous phases. Because powder having particles containing more $Fe_2B$ crystals exhibits a higher peak of $Fe_2B$ crystals, the percentage of particles having substantially rectangular structures can be relatively evaluated by the peak intensity of $Fe_2B$ crystals. In the diffraction spectrum shown in FIG. 10, the peaks of both FeSi crystals and $Fe_2B$ crystals were confirmed in the heat-treated powders of Examples 41 and 42 (Alloy M). The heat-treated powder of Reference Example 41 (alloy N) exhibited a peak of FeSi crystals, but no peak of $Fe_2B$ crystals. A ratio P2/P1 of the peak intensity P2 of $Fe_2B$ crystals to the peak intensity P1 of FeSi crystals was smaller in the powder of Example 42 having smaller particle sizes. The powder of Example 42 also had smaller coercivity.

100 parts of each powder of Examples 41 and 42 and Reference Example 41 was blended with 5 parts of a silicone resin, charged into a molding die, and molded under pressure of 400 MPa by a hydraulic press machine to produce a circular doughnut-shaped magnetic core of 13.5 mm in outer diameter, 7.7 mm in inner diameter and 2.0 mm in thickness. The space factor, core loss, initial permeability, and permeability increment of each magnetic core were evaluated. The results are shown in Table 10.

Space Factor (Relative Density)

The circular doughnut-shaped magnetic cores subjected to the magnetic measurement were heat-treated at 250° C. to decompose the binder, thereby obtaining powders, whose densities ($kg/m^3$) were calculated from the weight of each powder and the size and mass of each circular doughnut-shaped magnetic core by a volume-weight method, and each density was divided by the true density of each powder of Alloys M and N determined by a gas substitution method to obtain the space factor (relative density, %) of each magnetic core.

Magnetic Core Loss

Each circular doughnut-shaped magnetic core was provided with primary and secondary windings each 18 turns, to measure core loss ($kW/m^3$) at the maximum magnetic flux density of 30 mT and a frequency of 2 MHz, and at room temperature (25° C.), by a B-H analyzer SY-8218 available from Iwatsu Electric Co., Ltd.

Initial Permeability μi

A conductor wire was wound around the circular doughnut-shaped magnetic core by 30 turns to form a coil device, whose inductance was measured at room temperature and a frequency of 100 kHz by an LCR meter (4284A available from Agilent Technologies Japan, Ltd.). The initial permeability μi was determined by the formula below. The initial permeability μi was obtained at an AC magnetic field of 0.4 A/m.

Initial permeability $\mu i=(1e\times L)/(\mu_0\times Ae\times N^2)$, wherein 1e is the length of a magnetic path, L is the inductance (H) of a sample, $\mu_0$ is vacuum permeability$=4\pi\times10^{-7}$ (H/m), Ae is a cross section area of the magnetic core, and N is the number of winding of the coil.

Permeability Increment μΔ

The inductance L of the coil device used for the initial permeability measurement was measured at a frequency of 100 kHz and room temperature (25° C.), by an LCR meter (4284A available from Agilent Technologies Japan, Ltd.), with a DC magnetic field of 10 kA/m applied by a DC bias-applying apparatus (42841A available from Hewlett-Packard Company). The permeability increment μΔ was determined from the inductance by the same formula as for the initial permeability μi. A ratio μΔ/μi (%) of the permeability increment μΔ to the initial permeability μi was calculated.

TABLE 10

| No. | Space Factor (%) | Magnetic Core Loss ($kW/m^3$) | Initial Permeability μi | μΔ/μi (%) |
|---|---|---|---|---|
| Example 41 | 67.8 | 12600 | 11.4 | 94.9 |
| Example 42 | 68.3 | 6800 | 12.9 | 94.8 |
| Ref. Ex. 41 | 64.1 | 4300 | 16.7 | 71.6 |

The magnetic cores formed by the powders of Examples 41 and 42 (present invention) stably exhibited substantially constant DC superimposition characteristics, with sufficiently small permeability change by the current change. The magnetic core using the magnetic core powder of Example 42 having a smaller peak intensity ratio P2/P1 exhibited smaller core loss and larger initial permeability. With low permeability, the magnetic core should have a large cross section area and a large number of turns in winding to obtain necessary inductance, so that the coil device must be large. In this respect, the powder of Example 42 is advantageous in making the coil devices smaller.

What is claimed is:

1. An alloy powder having an alloy composition represented by $Fe_{100-a-b-c-d-e-f}Cu_aSi_bB_cCr_dSn_eC_f$, wherein a, b, c, d, e and f are atomic % meeting $0.80\le a\le1.80$, $2.00\le b\le10.00$, $11.00\le c\le17.00$, $0.10\le d\le2.00$, $0.22\le e\le1.50$, and $0.10\le f\le0.40$.

2. An Fe-based, nanocrystalline alloy powder having an alloy composition represented by $Fe_{100-a-b-c-d-e-f}Cu_aSi_bB_cCr_dSn_eC_f$, wherein a, b, c, d, e and f are atomic % meeting $0.80\le a\le1.80$, $2.00\le b\le10.00$, $11.00\le c\le17.00$, $0.10\le d\le2.00$, $0.22\le e\le1.50$, and $0.10\le f\le0.40$; and an alloy structure containing 20% or more by volume of nanocrystalline structures having an average crystal grain size of 10-50 nm.

3. The Fe-based, nanocrystalline alloy powder according to claim 2, having a saturation magnetic flux density Bs of 1.50 T or more.

4. The Fe-based, nanocrystalline alloy powder according to claim 2, wherein said Fe-based, nanocrystalline alloy powder comprises 10% or less by mass of powder having particle sizes of more than 40 μm, 30% or more and 90% or less by mass of powder having particle sizes of more than 20 μm and 40 μm or less, and 5% or more and 60% or less by mass of powder having particle sizes of 20 μm or less.

5. A magnetic core formed by the Fe-based, nanocrystalline alloy powder recited in claim 2.

6. The magnetic core according to claim 5, wherein a ratio μ10 k/μi of permeability μ10 k at a magnetic field intensity H=10 kA/m to initial permeability μi that is permeability at a magnetic field intensity H=0 kA/m is 0.90 or more.

7. An Fe-based, nanocrystalline alloy powder having an alloy composition represented by $Fe_{100-a-b-c-d-e-f}Cu_aSi_bB_cCr_dSn_eC_f$, wherein a, b, c, d, e and f are atomic % meeting $0.80\le a\le1.80$, $2.00\le b\le10.00$, $11.00\le c\le17.00$, $0.10\le d\le2.00$, $0.01\le e\le1.50$, and $0.10\le f\le0.40$; and an alloy structure containing 20% or more by volume of nanocrystalline structures having an average crystal grain size of 10-50 nm, wherein said alloy structure contains substantially rectangular structures having longitudinal lengths of 20 nm or more and transverse widths of 10-30 nm.

8. The Fe-based, nanocrystalline alloy powder according to claim 7, wherein said substantially rectangular structures are present in an Fe-based, nanocrystalline alloy powder having particle sizes of more than 20 μm.

* * * * *